US008978970B2

(12) United States Patent
Nobuhara et al.

(10) Patent No.: US 8,978,970 B2
(45) Date of Patent: Mar. 17, 2015

(54) BANKNOTE PROCESSING APPARATUS AND BANKNOTE BUNDLE DISPENSING METHOD

(75) Inventors: Hiroshi Nobuhara, Hyogo (JP); Osamu Uehara, Hyogo (JP)

(73) Assignee: Glory Ltd., Himeji, Hyogo (JP)

( * ) Notice: Subject to any disclaimer, the term of this patent is extended or adjusted under 35 U.S.C. 154(b) by 831 days.

(21) Appl. No.: 12/924,321

(22) Filed: Sep. 24, 2010

(65) Prior Publication Data

US 2011/0072987 A1 Mar. 31, 2011

(30) Foreign Application Priority Data

Sep. 29, 2009 (JP) ..... 2009-225248

(51) Int. Cl.
*G07F 19/00* (2006.01)
*G07D 11/00* (2006.01)

(52) U.S. Cl.
CPC ..... *G07D 11/0084* (2013.01); *G07D 11/0021* (2013.01); *G07D 11/0051* (2013.01)
USPC ..... 235/379

(58) Field of Classification Search
USPC ..... 235/379; 194/206
See application file for complete search history.

(56) References Cited

U.S. PATENT DOCUMENTS

| | | | | |
|---|---|---|---|---|
| 3,939,621 | A | 2/1976 | Giori | 53/23 |
| 4,443,692 | A | 4/1984 | Nishimura | 235/379 |
| 5,522,511 | A | 6/1996 | Sakoguchi et al. | 209/534 |
| 6,502,052 | B1 | 12/2002 | Someya et al. | 702/128 |
| 7,337,888 | B2 * | 3/2008 | Neumann | 194/206 |
| 2009/0057093 | A1 * | 3/2009 | Iwami et al. | 194/206 |

FOREIGN PATENT DOCUMENTS

| | | | |
|---|---|---|---|
| JP | 8-87636 | 4/1996 | G07D 9/00 |
| JP | 11-278665 | 10/1999 | B65G 57/03 |
| JP | 3311088 | 5/2002 | G07D 9/00 |
| KR | 1020090093699 | 2/2009 | G07F 19/00 |

OTHER PUBLICATIONS

European Search Report (dated Jan. 17, 2011—6 pages).

* cited by examiner

*Primary Examiner* — Daniel Hess
(74) *Attorney, Agent, or Firm* — Renner, Kenner, Greive, Bobak, Taylor & Weber

(57) ABSTRACT

A banknote processing apparatus includes a dispensing transport unit for transporting banknote bundles, a bundle stacking unit for stacking the banknote bundles that are transported by the dispensing transport unit, a bundle dispensing unit for dispensing the banknote bundles that are stacked in the bundle stacking unit, a designating unit for designating a specific number of banknote bundles, and a control unit for controlling, when the number of banknote bundles reaches the specific number, the bundle dispensing unit to cause the bundle stacking unit to protrude to the outside of the apparatus to dispense the specific number of banknote bundles that are stacked in the bundle stacking unit, such that the banknote bundles can be taken out from the outside.

18 Claims, 15 Drawing Sheets

BANKNOTE PROCESSING APPARATUS AND BANKNOTE BUNDLE DISPENSING METHOD

CROSS-REFERENCE TO RELATED APPLICATIONS

This application is based upon and claims the benefit of priority from Japanese Patent Application No. 2009-225248, filed on Sep. 29, 2009, the entire contents of which are incorporated herein by reference.

BACKGROUND OF THE INVENTION

1. Field of the Invention

The present invention relates to a banknote processing apparatus that dispenses a predetermined number of banknotes that are bundled (hereinafter "banknote bundle") to the outside of the apparatus and relates to a banknote bundle dispensing method.

2. Description of the Related Art

Banknote inserting and dispensing machines that include a sorting unit, a bundling unit, and a dispensing unit are well known conventional banknote processing apparatuses (for example, see Japanese Patent No. 3311088). The sorting unit sorts inserted banknotes according to predetermined denominations. The bundling unit bundles, with a bundling band, a predetermined number of banknotes of each of the predetermined denominations, which are sorted by the sorting unit, so that a banknote bundle is prepared. Once one banknote bundle is prepared, the dispensing unit dispenses the prepared banknote bundle from a bundle dispensing port to the outside of the apparatus. According to Japanese Patent No. 3311088, inserted banknotes are sorted according to predetermined denominations and a predetermined number of banknotes of each sorted predetermined denomination are bundled, with a bundling band, into a banknote bundle, and banknote bundles can be dispensed individually from the bundle dispensing port.

For conventional banknote processing apparatuses, a technology is known in which there is a selectable mode in which banknote bundles are stacked in a bundle stacking unit and a predetermined number of banknote bundles are collectively dispensed to the outside of the apparatus and in which there is a selectable mode in which banknote bundles are individually dispensed to the outside of the apparatus (see Japanese Laid-open Patent Publication No. 08-87636). According to Japanese Laid-open Patent Publication No. 08-87636, banknote bundles can be dispensed individually or in multiples.

In addition, for conventional banknote processing apparatuses, a technology is known in which dispensing ports corresponding to the number of banknote bundles are provided and banknote bundles are dispensed through predetermined dispensing ports in accordance with the number of banknote bundles (for example, see Japanese Laid-open Patent Publication No. 11-278665). According to Japanese Laid-open Patent Publication No. 11-278665, for example, banknote bundles are dispensed from the upper dispensing port when the number of the banknote bundles is less than three, and banknote bundles are dispensed from the lower dispensing port when the number of the banknote bundles is three or more. Thus, banknote bundles can be dispensed from corresponding dispensing ports in accordance with the number of banknote bundles.

In the conventional banknote processing apparatuses, banknote bundles are successively dispensed to the outside of the apparatus. However, users cannot designate the number of banknote bundles to be collectively dispensed and thus a user's desired specific number of banknote bundles cannot be dispensed; therefore, the above-described conventional banknote processing apparatuses require a user's manual operation when collecting a predetermined number of banknote bundles, which imposes an operational burden on the user.

For example, when banknote bundles are collected from circulated loose banknotes in a ten-banknote-bundles basis, the ten banknote bundles are manually collected. If the unbundled banknotes are unfit notes, the banknote bundles are bulky and the work accumulating and collecting the 10 banknote bundles is significantly time-consuming.

SUMMARY OF THE INVENTION

A banknote processing apparatus according to an aspect of the present invention includes a bundle transport unit for transporting banknote bundles; a bundle stacking unit for stacking the banknote bundles that are transported by the bundle transport unit; a bundle dispensing unit for dispensing the banknote bundles that are stacked in the bundle stacking unit; a designating unit for designating a specific number of banknote bundles; and a control unit for controlling, when the number of banknote bundles reaches the specific number that is designated by the designating unit, the bundle dispensing unit to dispense the specific number of banknote bundles that are stacked in the bundle stacking unit, such that the banknote bundles can be taken out from the outside.

A banknote bundle dispensing method according to another aspect of the present invention is for a banknote processing apparatus that includes a bundle transport unit for transporting banknote bundles, a bundle stacking unit for stacking the banknote bundles that are transported by the bundle transport unit, and a bundle dispensing unit for dispensing the banknote bundles that are stacked in the bundle stacking unit. The method includes designating a specific number of banknote bundles; and controlling, when the number of banknote bundles reaches the specific number, the bundle dispensing unit to dispense the specific number of banknote bundles that are stacked in the bundle stacking unit such that the banknote bundles can be taken out from the outside.

The above and other features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of the present invention will be described in detail below with reference to the accompanying drawings.

First, an overview of the embodiments will be described. Banknote processing apparatuses include a bundle transport unit, a bundle stacking unit, a bundle dispensing unit, a designating unit, and a control unit. The bundle transport unit transports banknote bundles, which are bundled banknotes with bundling bands. The bundle stacking unit successively stacks the banknote bundles that are transported by the bundle transport unit. The designating unit designates a user's desired specific bundle number in accordance with a user's operation. When the number of banknote bundles reaches the specific number that is designated by the designating unit, the control unit controls the bundle dispensing unit in order to dispense the specific number of banknote bundles, which are stacked in the bundle stacking unit, such that the banknote bundles can be taken out from the outside.

In the banknote processing apparatus, when the number of banknote bundles reaches a specific number designated by the designating unit, the specific number of banknote bundles that are stacked in the bundle stacking unit are dispensed such that the banknote bundles can be taken out from the outside. This significantly improves operability for collecting the user's desired specific number of banknote bundles.

First Embodiment

Figure 1:
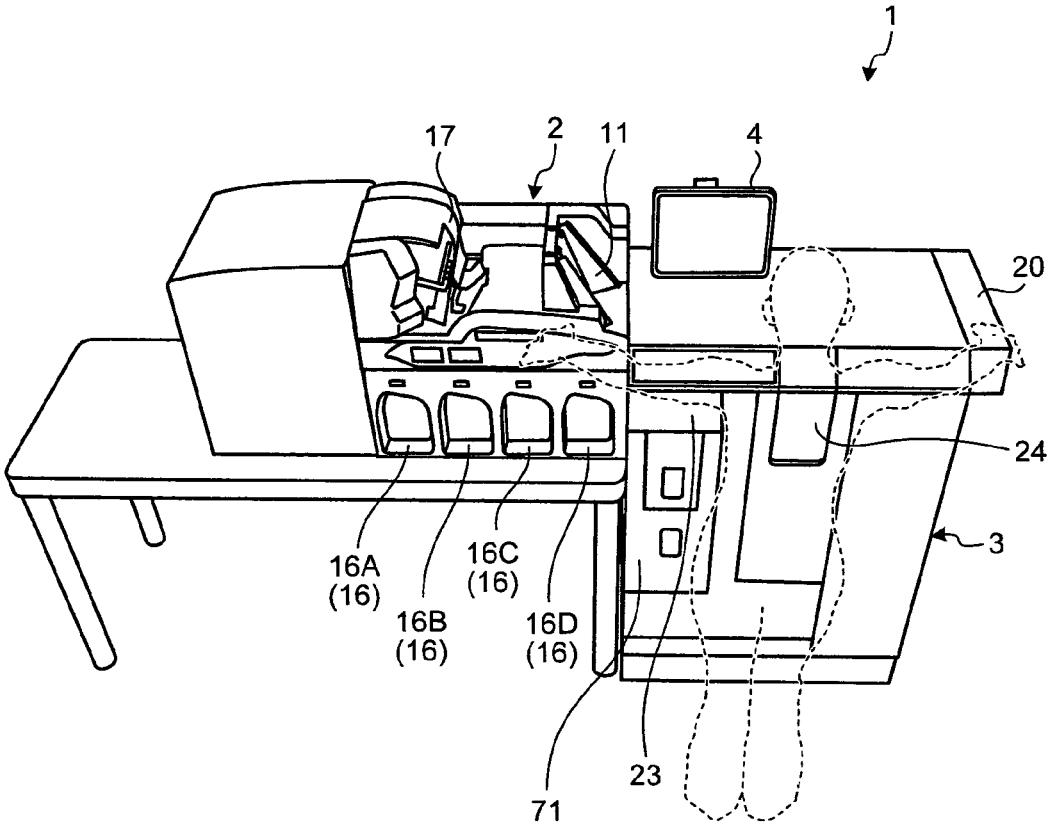
FIG. 1 is a perspective view of the outer configuration of a banknote processing apparatus according to a first embodiment.
Figure 2:
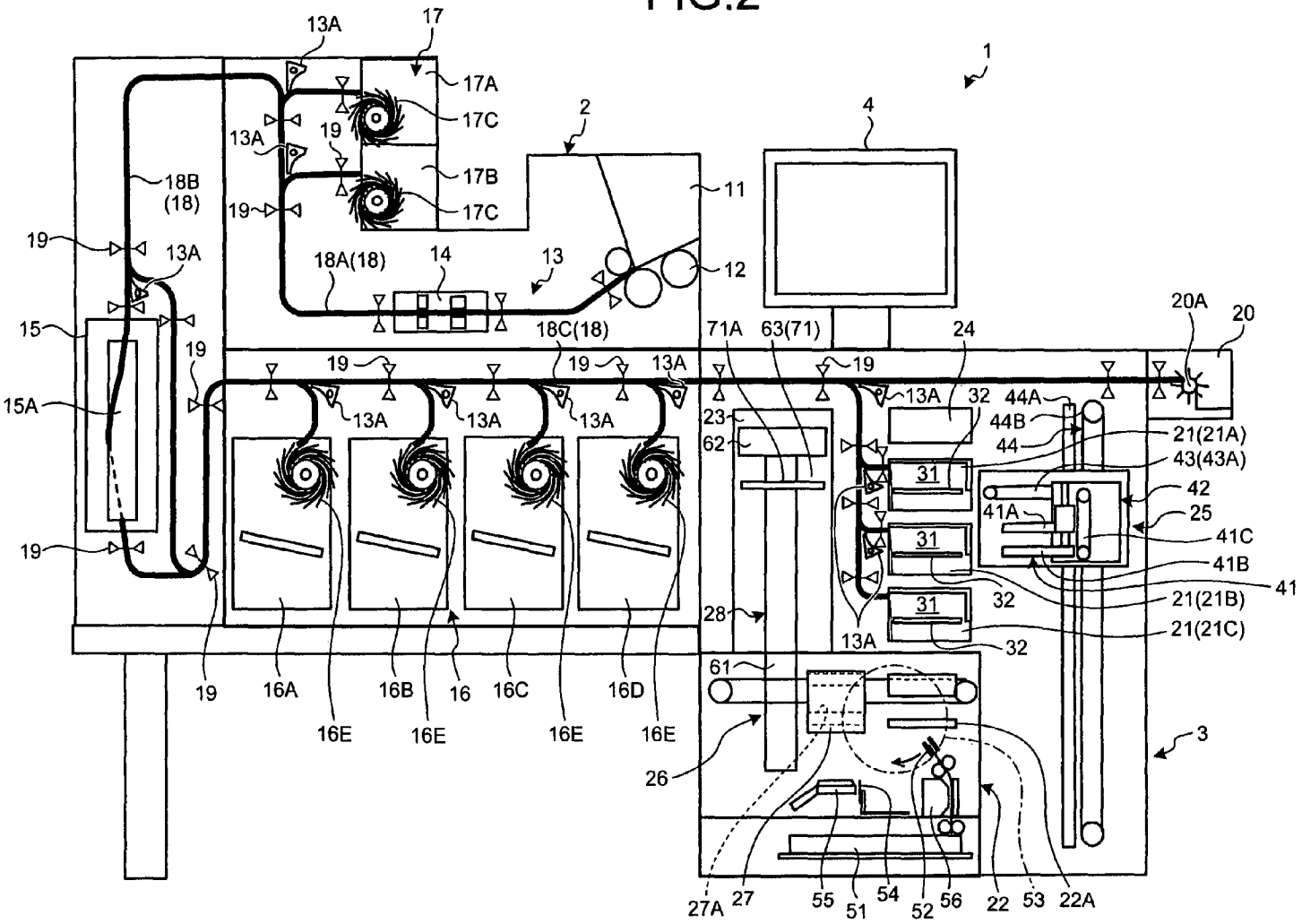
FIG. 2 is an explanatory view of the inner configuration of the banknote processing apparatus according to the first embodiment.

FIG. 1 is a perspective view of the outer configuration of a banknote processing apparatus according to a first embodiment and FIG. 2 is an explanatory view of the inner configuration of the banknote processing apparatus according to the first embodiment.

A banknote processing apparatus 1 includes a banknote sorting unit 2, a banknote bundling unit 3, and a display unit 4. Banknotes to be handled are successively put in the banknote sorting unit 2, and the banknote sorting units 2 sorts and stacks the put banknotes according to banknote types and counts the number of each type of put banknotes. The banknote bundling unit 3 bundles a predetermined number of a specific denomination of banknotes, which are sorted by the banknote sorting unit 2, for example, into a banknote bundle of 100 banknotes. The display unit 4 displays various types of information, for example, on the counting results.

The banknote sorting unit 2 includes a hopper unit 11, a feeding unit 12, a banknote transport unit 13, a diverter unit 13A, a banknote recognition unit 14, a banknote reversing unit 15, a stacker 16, a first rejection unit 17, a banknote transport path 18, detection sensors 19, and a second rejection unit 20. The banknote transport path 18 includes a first transport path 18A, a second transport path 18B, and a third transport path 18C. The first transport path 18A is arranged in an upper position with respect to the stacker 16 and is connected to the hopper unit 11. The second transport path 18B is arranged such that it turns toward the position of the stacker 16 and is connected to the first transport path 18A. The third transport path 18C is connected to the second transport path 18B and is connected to the stacker 16 and a bundling stacking unit 21 in the banknote bundling unit 3. The second transport path 18B consists of an attachable/detachable unit that is connected to the first transport path 18A and the third transport path 18C.

The hopper unit 11 corresponds to an insertion port for inserting banknotes to be handled onto the banknote transport path 18. The feeding unit 12 feeds the inserted banknotes, which are to be handled, individually onto the banknote transport path 18. The banknote transport unit 13 consists of a transport belt and transports the banknotes, which are fed by the feeding unit 12, onto the banknote transport path 18.

The diverter unit 13A is arranged at a diverter portion on the banknote transport path 18 and sorts banknotes that are transported on the banknote transport path 18 into the stacker 16, the bundling stacking unit 21, the first rejection unit 17, and the second rejection unit 20. Upon detecting, via the detection sensor 19, the entering of the tip of a transported banknote, a solenoid (not shown) is driven and thus the diverter unit 13A sorts the transported banknotes. The banknote recognition unit 14 is arranged on the first transport path 18A and recognizes the types of the banknotes that are transported by the banknote transport unit 13. The banknote types include, in the case of Euro banknotes, seven denominations: 5 Euro, 10 Euro, 20 Euro, 50 Euro, 100 Euro, 200 Euro, and 500 Euro, and further includes authentication information for recognizing genuine banknotes and counterfeit banknotes, fit/unfit information for recognizing fit notes and unfit notes, and front/back information for recognizing the front and back of banknotes. In other currencies, the banknote types include print information for recognizing old or new version of banknotes of each denomination.

The banknote reversing unit 15 is arranged on the second transport path 18B and sorts transported banknotes at the diverter unit 13A, which is provided in front of the banknote reversing unit 15, into a reverse route and a non-reverse route in accordance with front/back information that represents a banknote type from the banknote recognition unit. The banknote reversing unit 15 transports the sorted banknotes to the third transport path 18C with all the transported banknotes facing up or all the transported banknotes facing down. The reverse route has a reversing member 15A, a transport belt (not shown), a drive motor that drives the transport belt, and a guide unit (not shown) (see Japanese Patent No. 4119664). The reversing member 15A has a curved surface that extends in the direction in which the banknotes are transported. The transport belt is suspended so as to be oblique to the longitudinal direction of the reversing member 15A such that a part of the transport belt runs along the curved surface of the reversing member 15A. The guide unit is sandwiched by the transport belt and the reversing member 15A, slides on the banknote surface, and guides the banknote, which is transported in the longitudinal direction of the reversing member 15A while being wound around the curved surface of the reversing member 15A.

In the banknote reversing unit 15, if a banknote is transported with the transport belt being driven by the drive motor, the banknote is sandwiched between the transport belt and the reversing member 15A and is moved in accordance with the movement of the transport belt in the transport direction. In this case, because the transport belt is suspended over the curved surface such that the transport belt is oblique to the longitudinal direction of the reversing member 15A, the banknote is transported while being wound around the curved surface and is reversed while rotating. During the reversion, because the guide unit guides the banknote while sliding on the banknote surface, the banknote is reliably reversed while the movement of the banknote is regulated during transport.

For example, when transporting a banknote while keeping it facing up to the third transport path 18C, the banknote reversing unit 15 transports the banknote to the third transport path 18C via the non-reverse route while keeping the transported banknote facing up without performing a reversing process by the banknote reversing unit 15. For example, when transporting a banknote that faces down to the third transport path 18C while reversing the transported banknote to face up, the banknote reversing unit 15 puts the banknote, which faces down, to face up by performing a longitudinal reversing process of the banknote reversion unit 15 via the reverse route and transports the banknote to the third transport path 18C.

The stacker 16 includes first to fourth stackers 16A to 16D for sorting and stacking transported banknotes according to each banknote type, which is set. Each stacker 16 has a stacking wheel 16E that individually stacks transported banknotes in a predetermined position in a banknote stacking space.

Two first rejection units 17 are arranged. The first rejection units 17 reject banknotes that do not apply to the banknote types corresponding to the stacker 16 and the banknote bundling unit 3. The first rejection unit 17 has a stacking wheel 17C that stacks transported banknotes individually in a predetermined position in a banknote stacking space. The detection sensor 19 detects that a transported banknote enters or passes thorough a diverter portion, a confluent portion, or a portion in which devices are connected, on the banknote transport path 18. The second rejection unit 20 is arranged at the end of the third transport path 18C, and a fin wheel 20A for stacking transported banknotes individually in a predetermined position in a banknote stacking space is arranged in the second rejection unit 20.

The banknote bundling unit 3 includes, in addition to the banknote transport unit 13, the bundling stacking unit 21, a bundling unit 22, a bundle dispensing port 23, an odd note return port 24, a pre-bundling transport unit 25, and a post-bundling transport unit 26. The banknote transport unit 13 transports a specific money type of banknotes from the banknote transport path 18 in the banknote sorting unit 2 into the banknote bundling unit 3. The bundling stacking unit 21 is vertically three-layered in the banknote bundling unit 3 and sorts and stacks the specific money type of banknotes that are transported.

Figure 3:
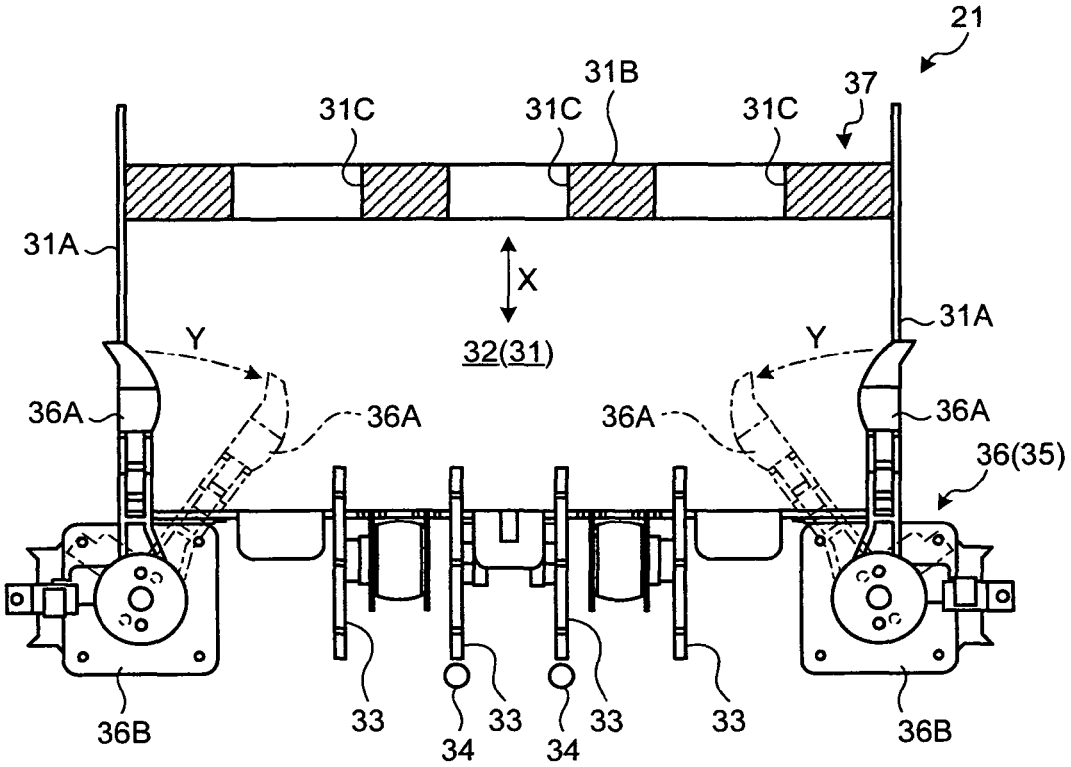
FIG. 3 is a plane view of the inner configuration of a bundling stacking unit.

FIG. 3 is an explanatory view of an inner configuration of the bundling stacking unit 21. The bundling stacking unit 21 includes a stacking space 31, a stage unit 32, a fin wheel 33, an enter detection sensor 34, and a size adjustment mechanism 35. The stacking space 31 consists of left and right wall portions 31A and a back wall portion 31B. As illustrated in FIG. 2, the stage unit 32 is arranged in the stacking space such that it can elevate and lower, and transported banknotes are stacked on the stage unit 32. In order to keep the level of the top banknote at a certain level, the stage unit 32 gradually lowers each time a transported banknote is stacked. The fin wheel 33 adjusts the position of transported banknotes that are stacked in the stacking space 31. The enter detection sensor 34 detects entering of a transported banknote into the stacking space 31. The size adjustment mechanism 35 adjusts the stacking space 31 in accordance with the size that is set for banknotes that are stacked in the bundling stacking unit 21.

The size adjustment mechanism 35 includes a banknote arrangement mechanism 36 and a short-edge adjustment mechanism 37. The banknote arrangement mechanism 36 adjusts the position of the to-be-bundled-banknotes in a longitudinal direction, which are stacked in the stacking space 31, in accordance with the size of the set banknote that is to be stacked. The banknote arrangement mechanism 36 includes left and right arm units 36A and left and right stepping motors 36B. The arm units 36A are rotatably arranged at the end portions of the side wall portions 31A in the stacking space 31 and rotate in an inner direction Y in the stacking space 31. The stepping motors 36B rotate the left and right arm units 36A to the set rotation portions in accordance with the set banknote. The tip portions of the left and right arm units 36A, which rotate to the set rotation positions in accordance with the set banknote, hit the edges of stacked banknotes that are stacked on the stage unit 32 in the stacking space 31 so that the position of the stacked banknotes in a longitudinal direction is adjusted.

The short-edge adjustment mechanism 37 can move the back wall portion 31B backwards and forwards in the stacking space 31 in the transport direction X of the banknotes, and adjusts the short edge size of the stacking space 31 in the stacking space 31 in accordance with the short edge size of the set banknote that is to be stacked. The back wall portion 31B has, for example, three cutouts 31C that let a hand unit 41 (see FIG. 2) enter the stacking space 31. The lower portion of the back wall portion 31B is an openable and closable shutter structure such that the hand unit 41 that enters via the cutouts 31C grips the long edge of the to-be-bundled-banknotes in the stacking space 31 and the gripped to-be-bundled-banknotes can be pulled out of the stacking space 31.

The bundling unit 22 is arranged in a lower position with respect to these three bundling stacking units 21 (see FIG. 2). If the number of to-be-bundled-banknotes that are sorted and stacked in the bundling stacking unit 21 reaches a predetermined number (for example, 100), the bundling unit 22 prepares a banknote bundle by bundling 100 banknotes with a bundling band. The bundling unit 22 further includes a bundling band reel 51, a bundling band stopper 52, a pivot arm 53, a cutter unit 54, a heater unit 55, and a printing unit 56. The bundling band reel 51 is a part for storing bundling bands. In a state in which a bundling position on the to-be-bundled-banknotes is set to a bundling operation position on a bundling stage, the bundling band stopper 52 stops the tip of a bundling band, which is drawn from the bundling band reel 51, in the bundling position on the to-be-bundled-banknotes. The bundling stage corresponds to a bundling operation area in the bundling unit 22.

The pivot arm 53 draws the bundling band, which is stopped in the bundling position on the to-be-bundled-banknotes, from the bundling band reel 51 and winds the drawn bundling band in the bundling position around the bundling subject banknotes. The cutter unit 54 cuts the other end of the bundling band, which is wound around the bundling position on the to-be-bundled-banknotes. The heater unit 55 thermally bonds the other end of the bundling band, which is cut by the cutter unit 54. The printing unit 56 prints arbitrary characters on the bundling band, which is drawn from the bundling band reel.

The bundle ejecting port 23 is arranged near the hopper unit 11 and corresponds to a dispensing port for dispensing a banknote bundle, which is bundled by the bundling unit 22, to the operator. The odd note return port 24 is arranged near the bundling stacking unit 21 and corresponds to a return port for ejecting odd banknotes that are stacked in the bundling stacking unit 21 to the operator when the handling is complete.

The pre-bundling transport unit 25 transports to-be-bundled-banknotes that are stacked in the bundling stacking unit 21 to the bundling unit 22 or the odd note return port 24. The pre-bundling transport unit 25 grips the long edge of 100 to-be-bundled-banknotes out of the to-be-bundled-banknotes, which are stacked in the bundling stacking unit 21, and transports the 100 to-be-bundled-banknotes to the bundling stage in the bundling unit 22. When the handling is complete, the pre-bundling transport unit 25 grips the odd banknotes, which are less than 100 out of the to-be-bundled-banknotes and which are stacked in the bundling stacking unit 21, and transports the odd banknotes to the odd note return port 24.

The pre-bundling transport unit 25 includes a transport unit 42 including the hand unit 41 and includes a horizontal movement mechanism 43 and a vertical movement mechanism 44. The hand unit 41 of the transport unit 42 collectively grips the long edge of to-be-bundled-banknotes that are stacked in the bundling stacking unit 21. The horizontal movement mechanism 43 is a mechanism that moves the transport unit 42 backwards and forwards (horizontally). The vertical movement mechanism 44 is a mechanism that moves the transport unit 42 up and down (vertically). The vertical movement mechanism 44 includes a guide shaft 44A that is set vertically and extends from the bottom end to the upper end in the banknote bundling unit 3 and a drive belt 44B that guides the transport unit 42 to elevate or lower the transport unit 42 using the guide shaft 44A.

The transport unit 42 includes the hand unit 41 that can move forward or back via a drive belt 43A in the horizontal movement mechanism 43. In the hand unit 41, for example, three grip claws of an upper hand 41A and three grip claws of a lower hand 41B are opposed to each other and the grip claws grip the long edge of the to-be-bundled-banknotes that are stacked in the bundling stacking unit 21. While the lower hand 41B is fixed, the upper hand 41A can move vertically via a drive belt 41C.

The transport unit 42 grips the long edge of the to-be-bundled-banknotes using the grip claws of the upper hand 41A and the grip claws of the lower hand 41B and transports the gripped to-be-bundled-banknotes to the operation preparation position on the bundling stage in the bundling unit 22 or to the odd note return port 24. While gripping the long edge of 100 to-be-bundled-banknotes using the transport unit 42, the pre-bundling transport unit 25 transports the to-be-bundled-banknotes to the operation preparation position on the bundling stage in the bundling unit 22 and arranges the banknotes thereon.

After gripping the banknote bundle that is bundled by the bundling unit 22 and transporting them in the longitudinal direction of the banknotes, the post-bundling transport unit 26 transports them toward the bundle ejecting port 23. The post-bundling transport unit 26 includes a grip transport unit 27 and a dispensing transport unit 28. After the pre-bundling transport unit 25 transports the to-be-bundled-banknotes to the bundling stage in the bundling unit 22, the grip transport unit 27 grips the short edge of the transported to-be-bundled-banknotes and transports the gripped banknotes in the longitudinal direction of the banknotes. The grip transport unit 27 then grips the banknote bundle that has been bundled by the bundling unit 22 and transports the banknote bundle.

While gripping the long edge of 100 to-be-bundled-banknotes via the transport unit 42, the grip transport unit 27 grips the short edge of the 100 to-be-bundled-banknotes at the operation preparation position on the bundling stage in the bundling unit 22. The transport unit 42 in the pre-bundling transport unit 25 releases the grip on the long edge of the to-be-bundled-banknotes, in accordance with operations of the grip transport unit 27 for gripping the short edge of the to-be-bundled-banknotes, and moves to a waiting position.

The grip transport unit 27 includes a grip unit 27A including upper and lower hands that collectively grip the short edge of banknotes. The grip unit 27A grips and transports the to-be-bundled-banknotes in the longitudinal direction of the banknotes from the operation preparation position in order to set the banknotes to the bundling operation position on the bundling stage.

While the short edge of the to-be-bundled-banknotes is gripped by the grip unit 27A of the grip transport unit 27, once the bundling position on the to-be-bundled-banknotes is positioned and set in the bundling operation position on the bundling stage, the bundling unit 22 performs the bundling operations for winding the bundling band around the bundling position on the to-be-bundled-banknotes.

When the operations for bundling the to-be-bundled-banknotes are completed by the bundling unit 22, the grip unit 27A of the grip transport unit 27 returns the banknote bundle to the operation preparation position and transports the banknote bundle into a banknote bundle lift unit 61 in the dispensing transport unit 28. Once the banknote bundle is transported into the banknote bundle lift unit 61, the grip transport unit 27 releases the grip on the short edge of the banknote bundle.

After the pre-bundling transport unit 25 transports the to-be-bundled-banknotes to the operation preparation position on a bundling stage 22A in the bundling unit 22, the grip transport unit 27 grips the short edge of the to-be-bundled-banknotes in the operation preparation position (see FIG. 8(C)). The pre-bundling transport unit 25 releases the grip on the long edge of the to-be-bundled-banknotes in accordance with the operation of the grip transport unit 27 for gripping the short edge of the to-be-bundled-banknotes. The operation preparation position corresponds to the position in which the to-be-bundled-banknotes are moved and adjusted with respect to the bundling operation position on the bundling stage 22A in which the bundling operations are performed, i.e., the position in which movement in the longitudinal direction of the to-be-bundled-banknotes is started. The bundling operation position corresponds to the operation position in which a bundling band is wound around the to-be-bundled-banknotes.

Once the grip transport unit 27 grips the to-be-bundled-banknotes in the operation preparation position on the bundling stage 22A of the bundling unit 22, the grip transport unit 27 moves and adjusts the to-be-bundled-banknotes in the longitudinal direction of the banknotes in order to set the bundling position on the to-be-bundled-banknotes in the bundling operation position on the bundling stage 22A (see FIG. 8(E) for which a description will be given). The bundling position on the to-be-bundled-banknotes is set in the bundling operation position on the bundling stage 22A and thus the bundling unit 22 winds the bundling band in the bundling position around the to-be-bundled-banknotes.

When the operation for bundling the to-be-bundled-banknotes is complete while the short edge of the to-be-bundled-banknotes is gripped by the bundling unit 22 in the bundling operation position on the bundling stage 22A, the grip transport unit 27 transports the banknote bundle to the operation preparation position (see FIG. 8(F)) and transports the banknote bundle to the dispensing transport unit 28.

The dispensing transport unit 28 transports the banknote bundle, which is gripped and transported by the grip transport unit 27, to the bundle dispensing port 23. The dispensing transport unit 28 includes the banknote bundle lift unit 61, a push-out mechanism 62, and a dispensing holding mechanism 63. The banknote bundle lift unit 61 transports the banknote bundle, which is transported by the grip transport unit 27, to an upper position of the banknote bundling unit 3. The push-out mechanism 62 pushes out the banknote bundle, which has been transported by the banknote bundle lift unit 61 to the upper position of the banknote bundling unit 3, toward the bundle dispensing port 23 (toward the front surface of the apparatus). The dispensing holding mechanism 63 stacks the banknote bundle, which has been pushed out by the push-out mechanism 62 to the apparatus front surface, and dispenses the banknote bundle.

Figure 4:
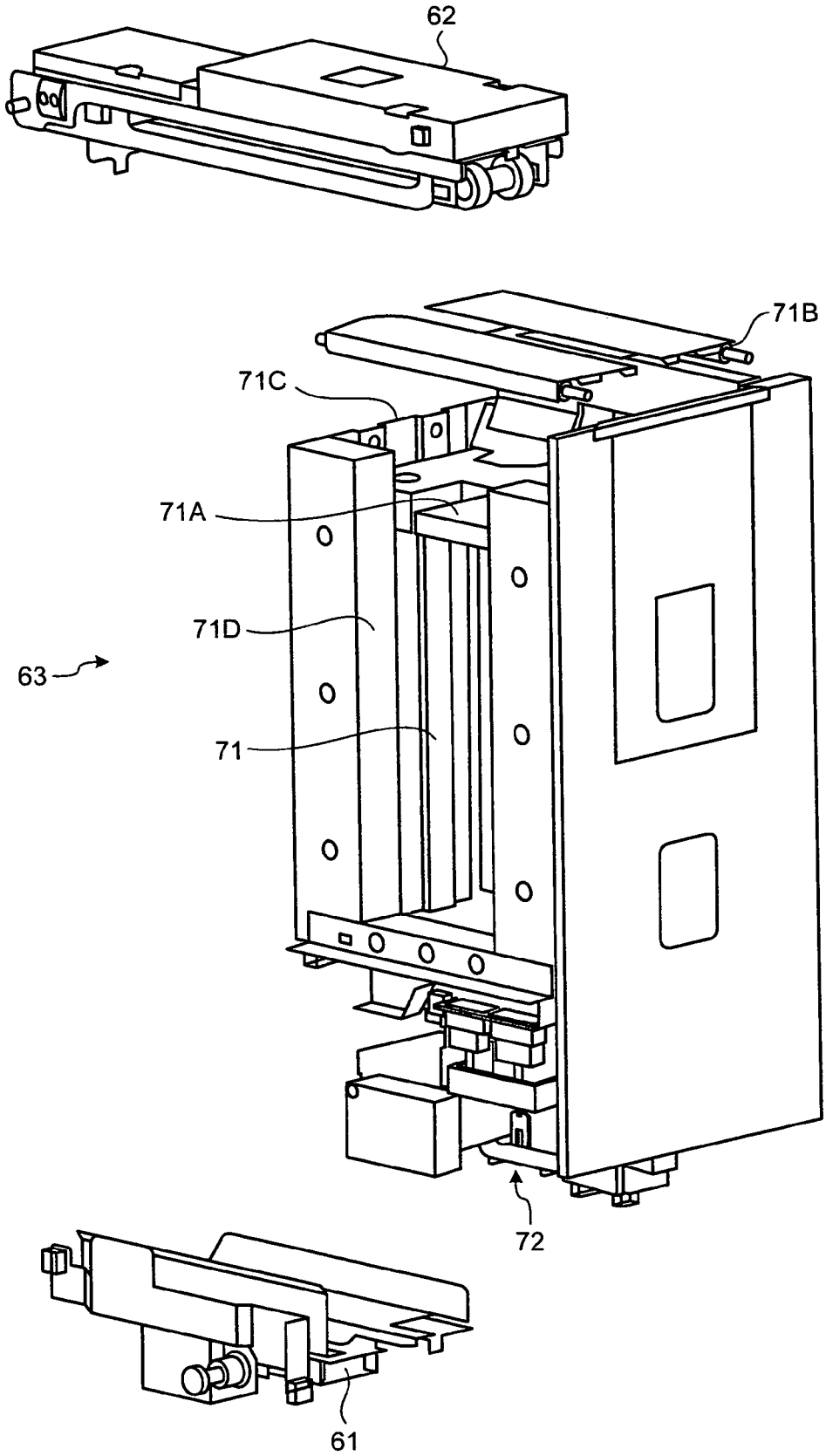
FIG. 4 is an exploded perspective view of a dispensing holding mechanism.

FIG. 4 is an exploded perspective view of the dispensing holding mechanism 63. The dispensing holding mechanism 63 illustrated in FIG. 4 includes a bundle stacking unit 71 and a bundle dispensing unit 72. The bundle stacking unit 71 includes a banknote bundle stage 71A and an open/close plate 71B. The banknote bundle stage 71A is arranged in the bundle stacking unit 71, and a banknote bundle, which has been pushed by the push-out mechanism 62, is placed on the banknote bundle stage 71A. The banknote bundle stage 71A has a mechanism that adjusts the level of the banknote bundle stage 71A such that banknote bundles are set to keep the level of the top banknote bundle at a specific position in the bundle stacking unit 71. The open/close plate 71B corresponds to a plate that opens or closes an upper opening 71C of the bundle stacking unit 71. When the bundled banknotes are pushed toward the front surface of the apparatus by the push-out mechanism 62, the bundled banknotes fall on the banknote bundle stage 71A in the bundle stacking unit 71 in accordance with an opening operation of the open/close plate 71B. The open/close plate 71B performs a closing operation by a spring back force and, for example, performs the opening operation using the weight of a banknote bundle. Alternatively, the open/close operations may be performed by a drive control.

The bundle dispensing unit 72 pushes out the bundle stacking unit 71 toward the front panel of the apparatus by releasing the lock of the bundle stacking unit 71 on the dispensing holding mechanism 63 (see FIG. 12 for which description will be given) so that the bundle stacking unit 71 protrudes from the front panel of the banknote bundling unit 3.

Banknote bundles are stacked in the bundle stacking unit 71 with the short edge of the banknote bundles being aligned in the back and forth direction of the bundle stacking unit 71, i.e., the direction of the pushing operation, and with the long edge of the banknote bundles being aligned with the left and right side surfaces of the bundle stacking unit 71. The bundle stacking unit 71 further includes a take-out opening 71D such that the side surface of the banknote bundles can be seen, i.e., contents printed on the bundling band can be seen from the take-out opening 71D. Banknote bundles can be taken out easily from the long edge side of the banknote via the take-out opening 71D. Thus, banknote bundles can be taken out of the bundle stacking unit 71 easily compared with taking out banknote bundles from the short edge of the banknotes.

Figure 5:
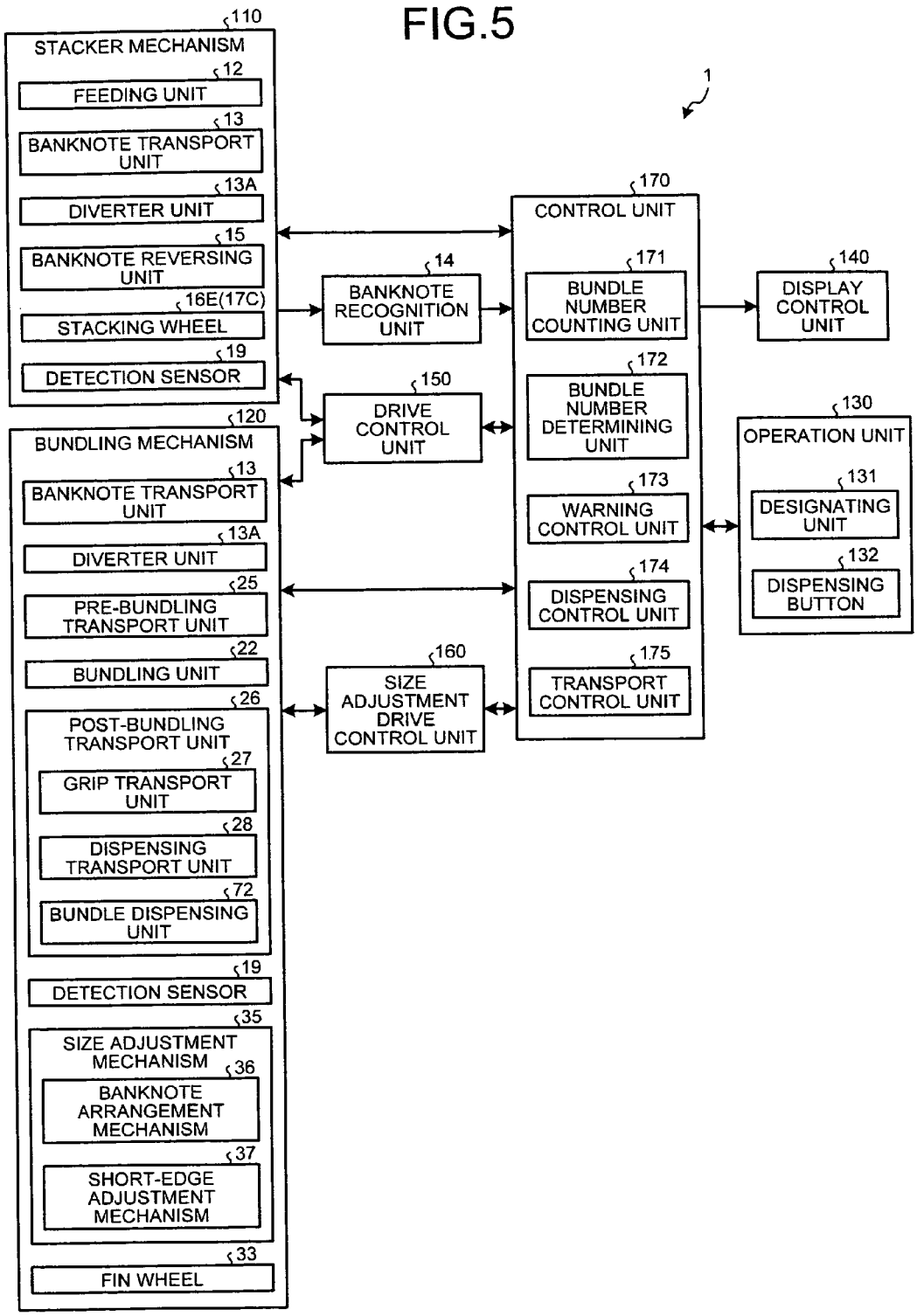
FIG. 5 is a block diagram of the inner configuration of the banknote processing apparatus.

FIG. 5 is a block diagram of an inner configuration of the banknote processing apparatus 1. The banknote processing apparatus 1 illustrated in FIG. 5 includes the banknote recognition unit 14, a stacker mechanism 110, a bundling mechanism 120, an operation unit 130, a display control unit 140, a drive control unit 150, a size adjustment drive control unit 160, and a control unit 170. The stacker mechanism 110 corresponds to the mechanism in the banknote sorting unit 2 and includes the pay-out unit 12, the banknote transport unit 13, the diverter unit 13A, the banknote reversing unit 15, the stacking wheel 16E (17C), and the detection sensor 19.

The bundling mechanism 120 corresponds to a mechanism in the banknote bundling unit 3 and includes the banknote transport unit 13, the diverter unit 13A, the detection sensor 19, the bundling unit 22, the pre-bundling transport unit 25, the post-bundling transport unit 26, the fin wheel 33, and the size adjustment mechanism 35. The post-bundling transport unit 26 includes the grip transport unit 27, the dispensing transport unit 28, and the bundle dispensing unit 72. The size adjustment mechanism 35 includes the banknote arrangement mechanism 36 and the short-edge adjustment mechanism 37.

When the number of banknote bundles that are stacked in the bundle stacking unit 71 reaches a specific number, the bundle dispensing unit 72 pushes out the bundle stacking unit 71 toward the front panel of the apparatus of the banknote bundling unit 3 so that the bundle stacking unit 71 protrudes from the front panel of the apparatus. The operation unit 130 inputs various commands and includes, for example, a designating unit 131 and a dispensing button 132. The designating unit 131 designates, as a specific number of banknote bundles, the number of banknote bundles with which the bundle stacking unit 71 is caused to protrude from the front panel of the apparatus, and the user can designate the number of times the specific number of banknote bundles is dispensed. In addition, a user can designate, via the designating unit 131, the total number of times the specific number of banknote bundles are dispensed. The dispensing button 132 starts the operation of the bundle dispensing unit 72 for causing the bundle stacking unit 71 to protrude.

The display control unit 140 performs display control on the display unit 4. The drive control unit 150 performs drive control on the stacker mechanism 110 and the bundling mechanism 120. Upon acquiring banknote types of transported banknotes that are recognized by the banknote recognition unit 14, if the banknotes that are being transported on the banknote transport path 18 are of a banknote type (stacked banknote) that is set for the stacker 16 or for the bundling stacking unit 21, the drive control unit 150 performs drive control on the banknote transport unit 13 and the diverter unit 13A in order to sort and stack the transported banknotes in the stacker 16 or the bundling stacking unit 21.

When banknotes which are being transported on the banknote transport path 18 are other than banknotes that are set for the stacker 16 and the bundling stacking unit 21 or banknotes that cannot be recognized due to, for example, a transport error, the drive control unit 150 performs drive control on the banknote transport unit 13 and the diverter unit 13A in order to transport the banknotes to the first rejection unit 17. Upon detecting an error in transport upstream relative to a first rejection unit 17B by the detection sensor 19, the drive control unit 150 successively transports the banknotes that are present upstream relative to the first rejection unit 17B, to the first rejection unit 17B.

Upon detecting an error in transport downstream relative to the first rejection unit 17B by the detection sensor 19, the drive control unit 150 performs drive control on the banknote transport unit 13 and the diverter unit 13A in order to successively transport the banknotes that are downstream relative to the first rejection unit 17B, to the second rejection unit 20. For example, in a location downstream relative to the first rejection unit 17B, such as in the second transport path 18B or the third transport path 18C, when an error occurs, for example, when a skewed banknote, chained banknotes, or overlapped banknotes are transported on the banknote transport path 18, the error can be recovered more quickly by transporting the error banknotes to the second rejection unit 20 rather than by stopping the banknote transport.

When the banknotes that are being transported on the banknote transport path 18 are of a banknote type (banknotes to be stacked) that is set for the bundling stacking unit 21, the drive control unit 150 performs drive control on the banknote transport unit 13 and the diverter unit 13A in order to sort the transported banknotes and transport the banknotes to the bundling stacking unit 21. When, as banknote types (banknotes to be stacked), a 10 Euro banknote is set for a first bundling stacking unit 21A, a 20 Euro banknote is set for a second bundling stacking unit 21B, and a reserve is set for a third bundling stacking unit 21C, once the number of to-be-bundled-banknotes, which are stacked in the first bundling stacking unit 21A, reaches 100, the drive control unit 150 performs drive control on the pre-bundling transport unit 25 in order to pull out the bundling subject banknotes that are stacked in the first bundling stacking unit 21A by the hand unit 41 in the transport unit 42 of the pre-bundling transport unit 25.

The size adjustment drive control unit 160 performs adjustment control on the size adjustment mechanism 35 in the bundling mechanism 120. The control unit 170 controls the entire banknote processing apparatus 1. The control unit 170 sets, for example, the types of banknotes to be stacked (banknotes to be stacked) for the stacker 16, the first rejection unit 17, the second rejection unit 20, and the bundling stacking unit 21. For example, the control unit 170 sets a 5 Euro banknote for the first stacker 16A, sets a 50 Euro banknote for the second stacker 16B, sets a 100 Euro banknote for the third stacker 16C, sets a 200 Euro banknote for the fourth stacker 16D, and sets a 500 Euro banknote for a first rejection unit 17A. As an initial setting, the control unit 170 further sets a 10 Euro banknote for the first bundling stacking unit 21A, sets a 20 Euro banknote for the second bundling stacking unit 21B, and sets a reserve for the third bundling stacking unit 21C. The first rejection unit 17A can be used as a stacker for stacking a rare type of banknote, such as a 500 Euro banknote. The control unit 170 identifies errors, such as jamming of banknotes on the banknote transport path 18, according to the detection results of the detection sensor 19.

The control unit 170 further includes a bundle number counting unit 171, a bundle number determining unit 172, a warning control unit 173, a dispensing control unit 174, and a transport control unit 175. The bundle number counting unit 171 counts the number of banknote bundles that are stacked in the bundle stacking unit 71 in accordance with the open operation of the open/close plate 71B. The bundle number determining unit 172 determines whether the number of banknote bundles, which is counted by the bundle number counting unit 171, reaches the designated number. When the number of banknote bundles reaches the designated number, the warning control unit 173 performs control to output warning sounds or a warning display. The warning display corresponds to, for example, a blinking display by the LED of the dispensing button 132. According to the warning sounds or warning display, the user can recognize that the number of banknote bundles that are stacked in the bundle stacking unit 71 has reached a designated banknote bundle number.

Figure 12:
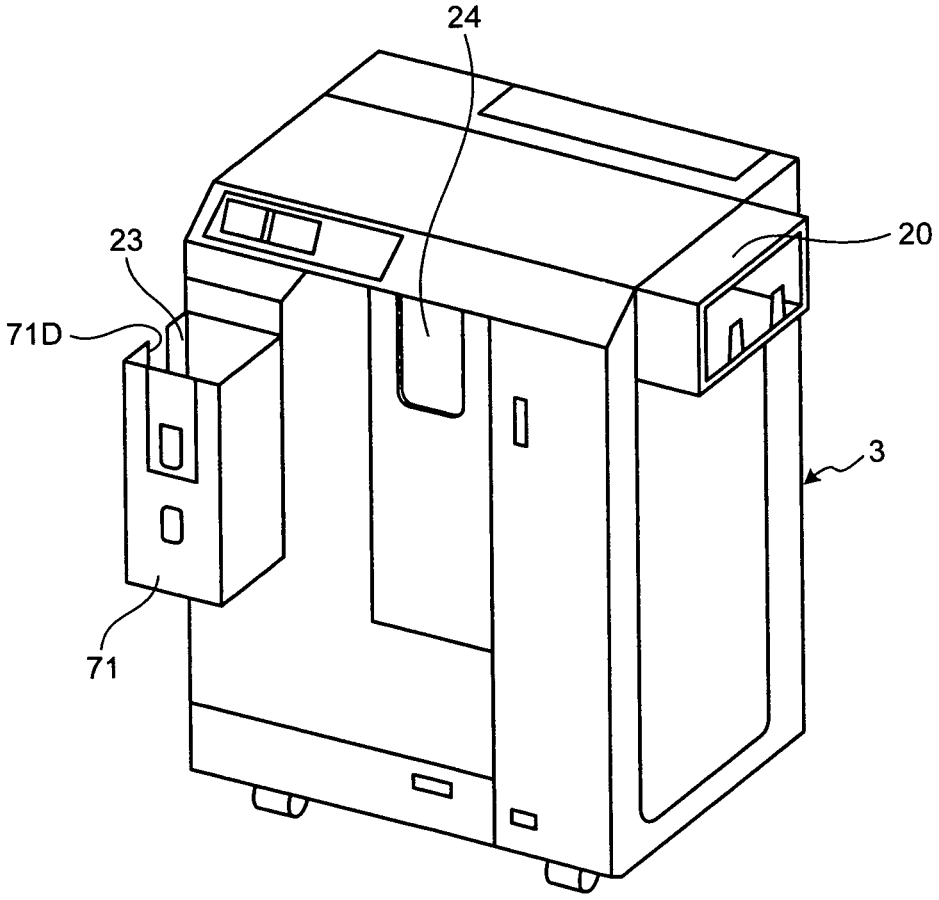
FIG. 12 is a perspective view of a banknote bundling unit illustrating that the bundle stacking unit protrudes from an front panel of the apparatus.

Upon detecting a button operation of the dispensing button 132, the dispensing control unit 174 releases the lock of the bundle stacking unit 71 on the dispensing holding mechanism 63 and performs drive control on the bundle dispensing unit 72 in order to perform the operation for causing the bundle stacking unit 71 to protrude (see FIG. 12). Upon detecting the releasing of the lock of the bundle stacking unit 71, the transport control unit 175 temporarily stops the operation for transporting a banknote bundle to the bundle stacking unit 71, such as the operation of the push-out mechanism 62 for transporting a banknote bundle to the bundle stacking unit 71. Upon detecting that the bundle stacking unit 71 is locked on the dispensing holding mechanism 63, the transport control unit 175 restarts the operation of the push-out mechanism 62 for a transport to the bundle stacking unit 71.

For example, when the number of 10 Euro banknotes that are stacked in the first bundling stacking unit 21A reaches 100, the control unit 170 switches the setting of the banknote type (banknotes to be stacked) for the reserve third bundling stacking unit 21C to a 10 Euro banknote. Further, the control unit 170 pulls out the 10 Euro banknotes, the number thereof has reached 100 banknotes, by the hand unit 41 in the transport unit 42, switches the setting of the banknote type (banknotes to be stacked) for the first bundling stacking unit 21A to "a reserve".

At the time when 100 to-be-bundled-banknotes that are stacked in the bundling stacking unit 21 are pulled out, the control unit 170 can recognize the designated number of banknote bundles that should be stacked in the bundle stacking unit 71 before they are stacked in the bundle stacking unit 71. The control unit 170 controls the printing unit 56, when preparing banknote bundles, in order to print an identical identification number on each of the bundling bands of the designated number of banknote bundles that are collectively dispensed from the bundle stacking unit 71. Because the identical identification numbers are printed on the bundling bands on the side surfaces of the banknote bundles, the user can recognize the identification numbers on the bundling bands from the take-out opening 71D of the bundle stacking unit 71.

When the number of 10-Euro banknotes that are stacked in the first bundling stacking unit 21A reaches 100 and the setting of the banknote type for the reserve third bundling stacking unit 21C (stacked banknotes) is switched to a 10 Euro banknote, the size adjustment drive control unit 160 performs drive control on the size adjustment mechanism 35 of the third bundling stacking unit 21C in order to adjust the third bundling stacking unit 21C in accordance with the set banknote, i.e., the banknote size of a 10 Euro banknote. The size adjustment drive control unit 160 manages the setting rotation position of the arm units 36A of the banknote arrangement mechanism 36 and the short edge size in the short-edge adjustment mechanism 37 according to each banknote type.

Figure 6:
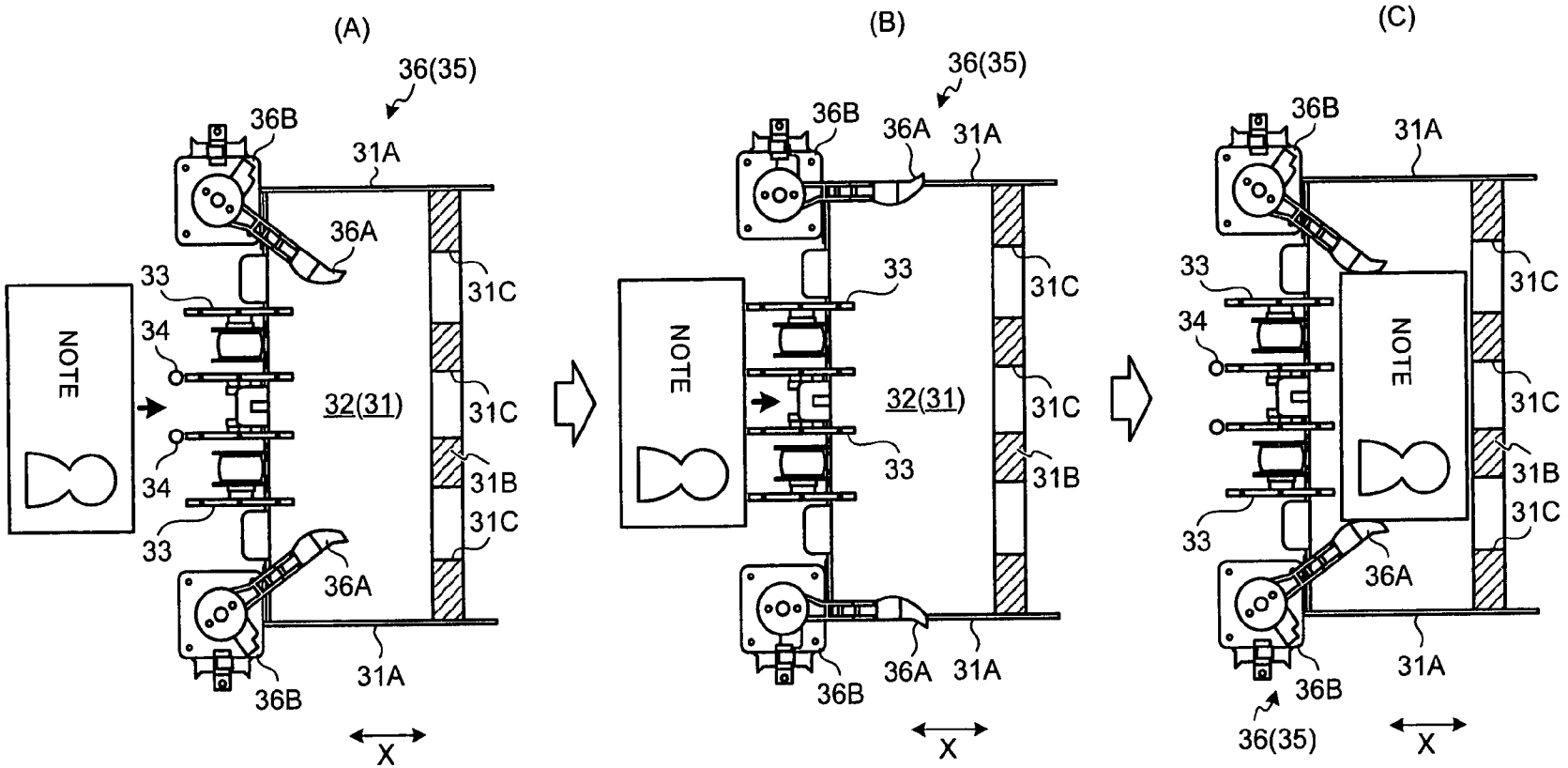
FIG. 6 is an explanatory view illustrating the operation flow of the bundling stacking unit.

An operation of the size adjustment drive control unit 160 for adjusting the size of the bundling stacking unit 21 in accordance with a set banknote will be described below. FIG. 6 is an explanatory view illustrating the operation flow of the bundling stacking unit 21. The size adjustment drive control unit 160 illustrated in FIG. 6 performs drive control on the short-edge adjustment mechanism 37 in order to adjust the stacking space 31 by moving the back wall portion 31B in accordance with the set banknote to be stacked. The size adjustment drive control unit 160 performs drive control on the banknote arrangement mechanism 36 in order to set the set rotation position of the arm units 36A of the banknote arrangement mechanism 36 in accordance with the longitudinal size of the set banknote.

First, the size adjustment drive control unit 160 moves the back wall portion 31B and sets the back wall portion 31B in a position corresponding to the short edge size of the set banknote so that the arm units 36A of the banknote arrangement mechanism 36 are kept in the set rotation position corresponding to the longitudinal size of the set size (see FIG. 6(A)).

Upon detecting the entering of a transported banknote into the stacking space 31 by the enter detection sensor 34, the size adjustment drive control unit 160 opens the left and right arm units 36A (see FIG. 6(B)). After detecting that the transported banknote has passed by the enter detection sensor 34 and then a predetermined time has passed, the size adjustment drive control unit 160 rotates the left and right arm units 36A to the set rotation position and adjusts the position of the long edge of the transported banknotes, which are stacked in the stacking space 31, using the tip portions of the left and right arm units 36A (see FIG. 6(C)). Accordingly, the transported banknotes are successively stacked in the stacking space 31 of the bundling stacking unit 21.

Figure 7:
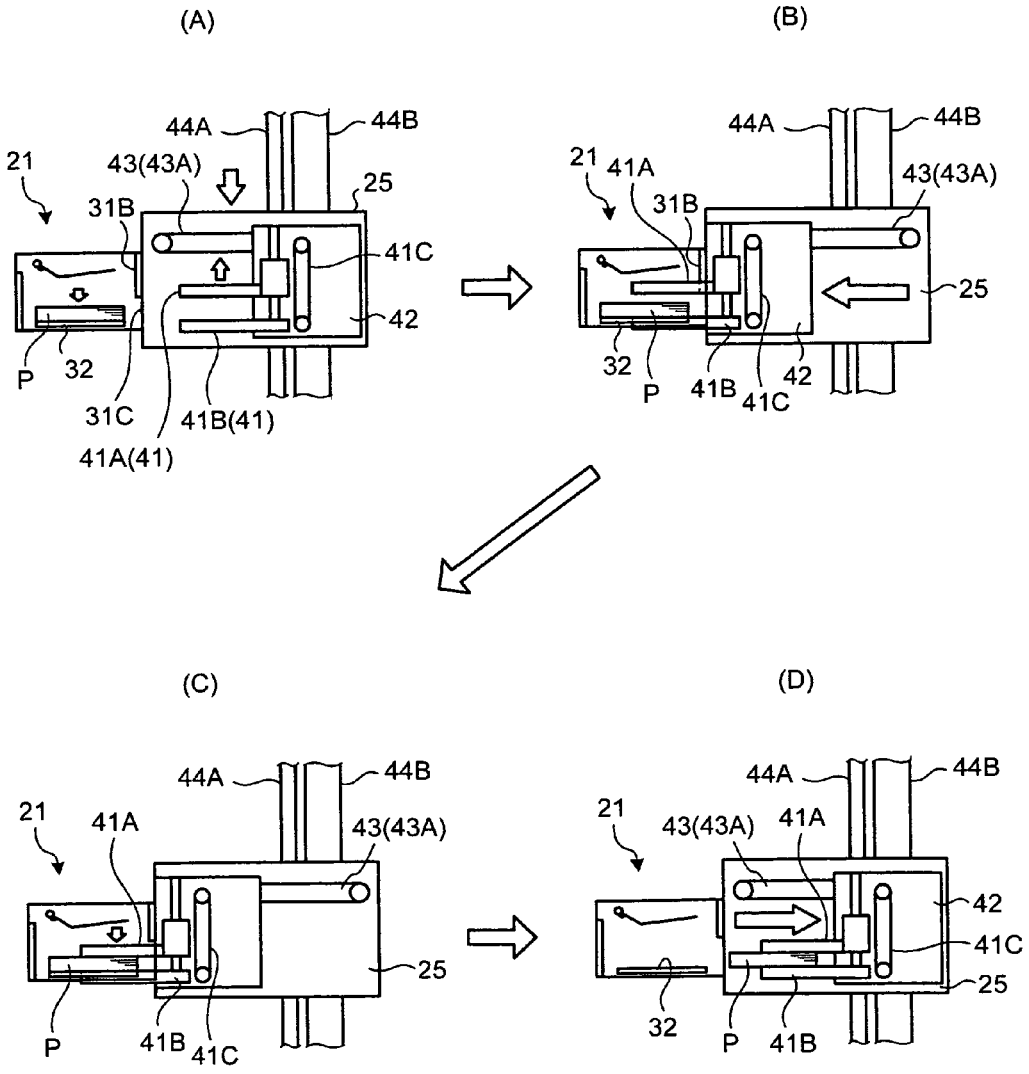
FIG. 7 is an explanatory view illustrating the operation flow of a pre-bundling transport unit.

An operation of the pre-bundling transport unit 25 for transporting banknotes that are successively stacked in the stacking space 31 of the bundling stacking unit 21 to the operation preparation position in the bundling unit 22 or to the odd note return port 24 will be described below. FIG. 7 is an explanatory view illustrating the operation flow of the pre-bundling transport unit 25.

When pulling out to-be-bundled-banknotes P that are stacked in the bundling stacking unit 21 by the transport unit 42, the pre-bundling transport unit 25 lowers the stage unit 32 in the bundling stacking unit 21, from which banknote are pulled out, to its lowest position (see FIG. 7(A)). In accordance with the operation of the drive belt 44B via the guide shaft 44A, the pre-bundling transport unit 25 lowers the transport unit 42 to a position corresponding to the bundling stacking unit 21, from which banknote are pulled out, i.e., to a position such that the upper surface of the lower hand 41B is lower than the bottom banknote of the to-be-bundled-banknotes P, which are stacked in the bundling stacking unit 21 (see FIG. 7(A)).

The pre-bundling transport unit 25 elevates, by the drive belt 41C, the upper hand 41A of the transport unit 42 by the drive belt 41C to a position such that the bottom surface of the upper hand 41A is higher than the top banknote of the to-be-bundled-banknotes P that are stacked in the bundling stacking unit 21 (see FIG. 7(A)). Accordingly, the space between the upper hand 41A and the lower hand 41B increases.

The transport unit 42 moves forwards in accordance with the operation of the drive belt 43A of the horizontal movement mechanism 43. In accordance with this forward movement, the upper hand 41A and the lower hand 41B enter the bundling stacking unit 21 via the cutouts 31C, which are formed on the back wall portion 31B of the bundling stacking unit 21. Accordingly, the to-be-bundled-banknotes P are positioned between the upper hand 41A and the lower hand 41B (see FIG. 7(B)). The transport unit 42 lowers the upper hand 41A via the drive belt 41C. In accordance with this lowering operation, the long edge of the to-be-bundled-banknotes on the stage unit 32 is tightly gripped between the upper hand 41A and the lower hand 41B (see FIG. 7(C)).

The transport unit 42 recedes in accordance with the operation of the drive belt 43A of the horizontal movement mechanism 43. In accordance with this receding operation, the to-be-bundled-banknotes P, which are held by the upper hand 41A and the lower hand 41B, can be moved to the operation preparation position on the bundling stage 22A in the bundling unit 22 or to the odd note return port 24 via the vertical movement mechanism 44 (see FIG. 7(D)).

For example, when the number of to-be-bundled-banknotes that are stacked in the bundling stacking unit 21 reaches 100, the drive control unit 150 causes the hand unit 41 of the transport unit 42 in the pre-bundling transport unit 25 to enter the stacking space 31 via the cutouts 31C on the back wall portion 31B. The hand unit 41 grips the long edge of the to-be-bundled-banknotes on the stage unit 32 and pulls out the gripped to-be-bundled-banknotes from the bundling stacking unit 21. The drive control unit 150 performs drive control on the pre-bundling transport unit 25 in order to transport the pulled-out to-be-bundled-banknotes to the bundling unit 22 via the horizontal movement mechanism 43 and the vertical movement mechanism 44.

If the number of to-be-bundled-banknotes that are stacked in the bundling stacking unit 21 does not reach 100 at the time when the handling finishes, the drive control unit 150 causes the hand unit 41 of the transport unit 42 to enter the stacking space 31 via the cutouts 31C on the back wall portion 31B. The hand unit 41 grips the long edge of the banknotes on the stage unit 32 and pulls out the gripped odd banknotes from the bundling stacking unit 21. The drive control unit 150 performs drive control on the pre-bundling transport unit 25 in order to transport the pulled-out odd to-be-bundled-banknotes to the odd note return port 24 via the horizontal movement mechanism 43 and the vertical movement mechanism 44. After the banknotes that are stacked in the bundling stacking unit 21 are pulled out, the drive control unit 150 elevates the stage unit 32 in the bundling stacking unit 21 to the normal banknote stacking waiting position.

Figure 8:
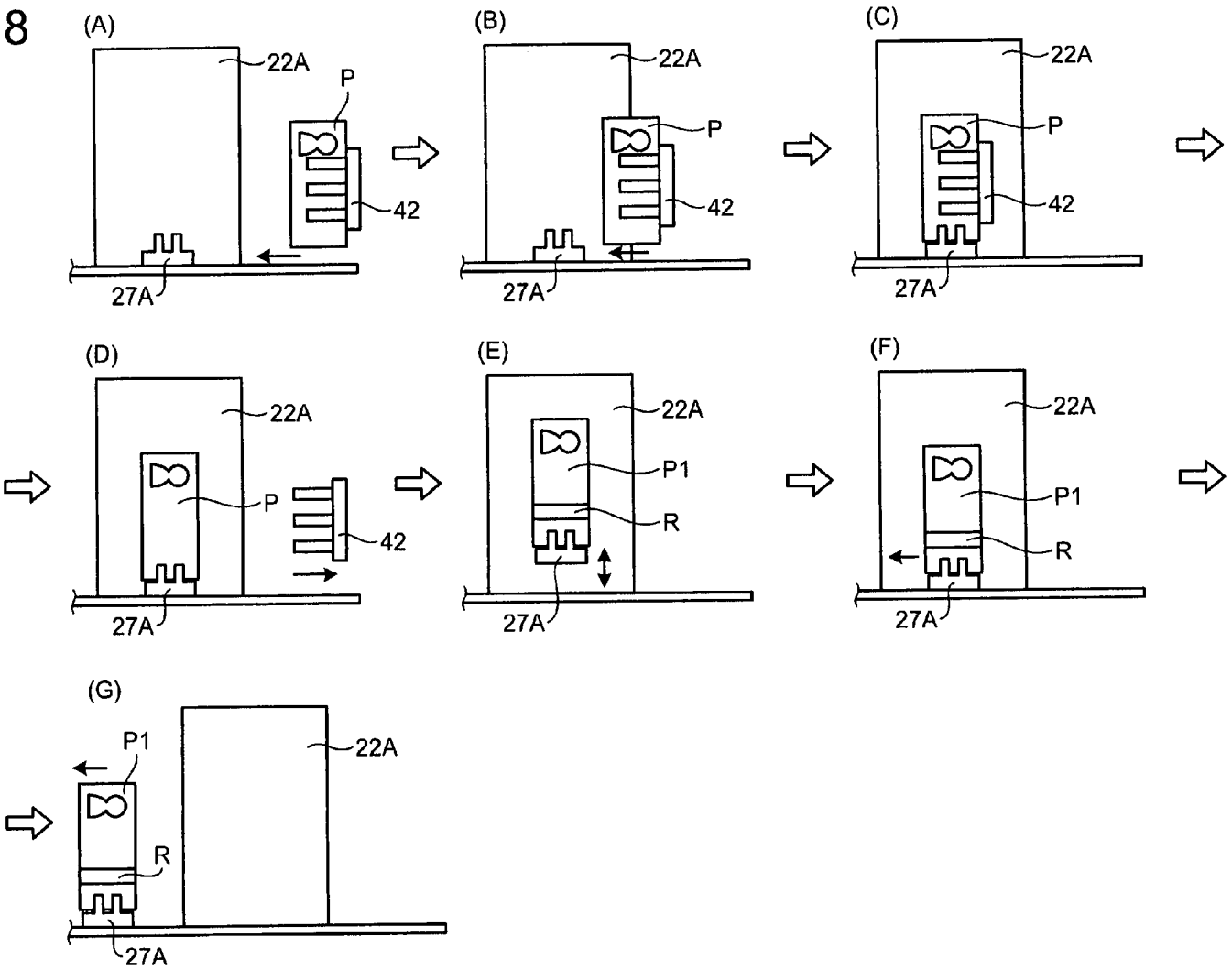
FIG. 8 is an explanatory view illustrating the operation flow of a grip transport unit.

The operation of the grip transport unit 27 for transporting the 100 to-be-bundled-banknotes P that are transported by the pre-bundling transport unit 25 will be described below. FIG. 8 is an explanatory view illustrating the operation flow of the grip transport unit 27. The transport unit 42 of the pre-bundling transport unit 25 illustrated in FIG. 8 grips the long edge of the to-be-bundled-banknotes P, which are stacked in the bundling stacking unit 21, and transports the gripped to-be-bundled-banknotes P to the vicinity of the port of the bundling unit 22 via the horizontal movement mechanism 43 and the vertical movement mechanism 44 (see FIG. 8(A)). The grip unit 27A of the grip transport unit 27 is arranged in the operation preparation position on the bundling stage 22A as illustrated in FIG. 8(A).

The transport unit 42 of the pre-bundling transport unit 25 transports the to-be-bundled-banknotes to the bundling stage 22A in the bundling unit 22 via the horizontal movement mechanism 43 (see FIG. 8(B)) and transports the to-be-bundled-banknotes to the operation preparation position on the bundling stage 22A (see FIG. 8(C)). Accordingly, the grip unit 27A of the grip transport unit 27 grips the short edge of the to-be-bundled-banknotes P in the operation preparation position in response to the transport of the to-be-bundled-banknotes P to the operation preparation position by the transport unit 42 (see FIG. 8(C)).

In accordance with the operation of the grip unit 27A of the grip transport unit 27 for gripping the to-be-bundled-banknotes P, the transport unit 42 of the pre-bundling transport unit 25 releases the grip on the long edge of the to-be-bundled-banknotes P (see FIG. 8(D)) and returns to the normal banknote stacking waiting position. The grip unit 27A of the grip transport unit 27 moves in the longitudinal direction of the to-be-bundled-banknotes P in order to position and set the bundling position on the to-be-bundled-banknotes P in the bundling operation position on the bundling stage 22A (see FIG. 8(E)). With the short edge of the to-be-bundled-banknotes P being gripped by the grip unit 27A, the bundling unit 22 prepares a banknote bundle P1 by winding a bundling band R in the bundling position around the to-be-bundled-banknotes P, which is positioned in the bundling operation position on the bundling stage 22A. The grip unit 27A of the grip transport unit 27 moves the banknote bundle P1, which is set and positioned in the bundling operation position on the bundling stage 22A, to the operation preparation position (see FIG. 8 (F)) and transports the banknote bundle P1 to the dispensing transport unit 28 (see FIG. 8(G)).

Figure 9:
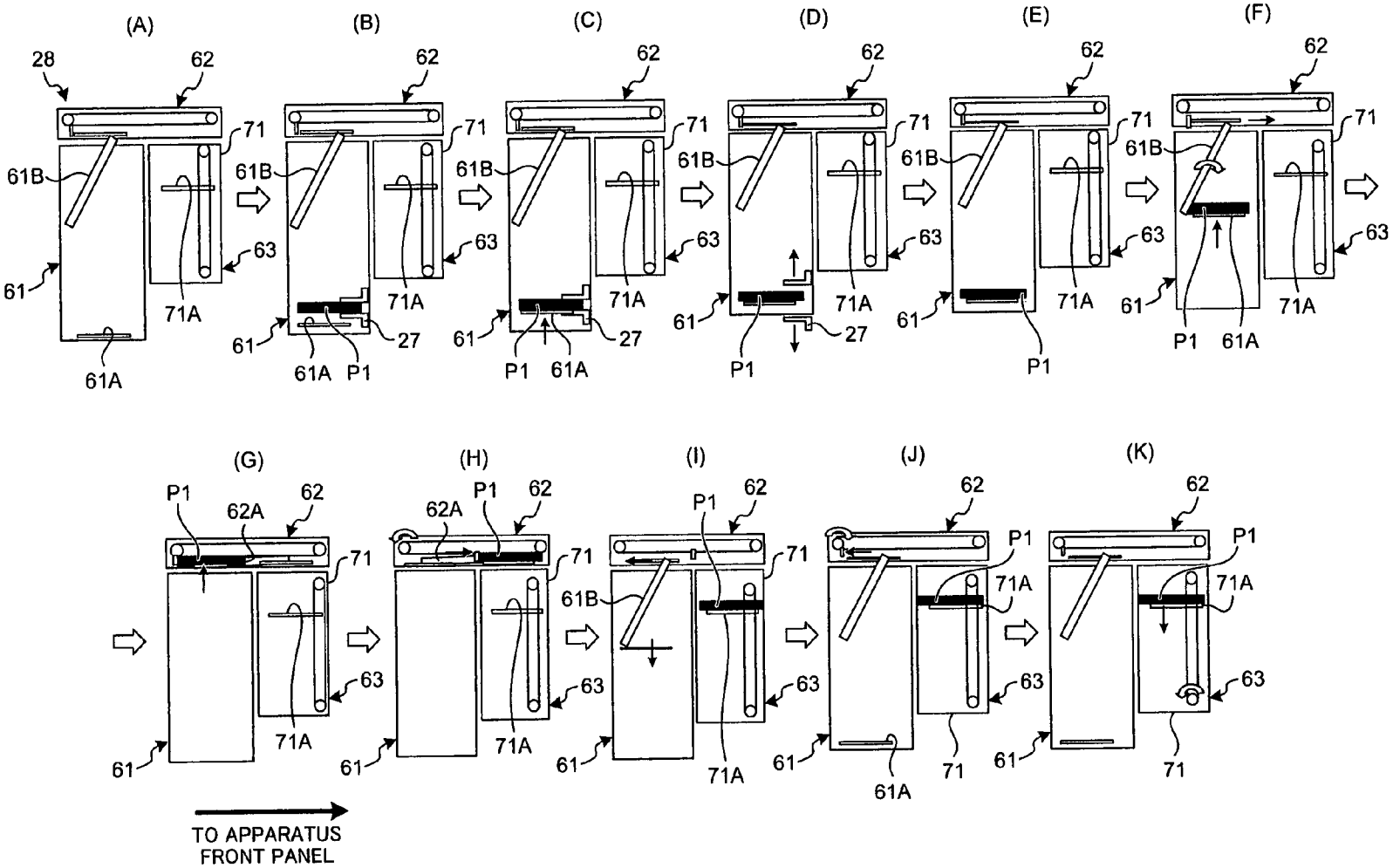
FIG. 9 is an explanatory view illustrating the operation flow of a dispensing transport unit.
Figure 10:
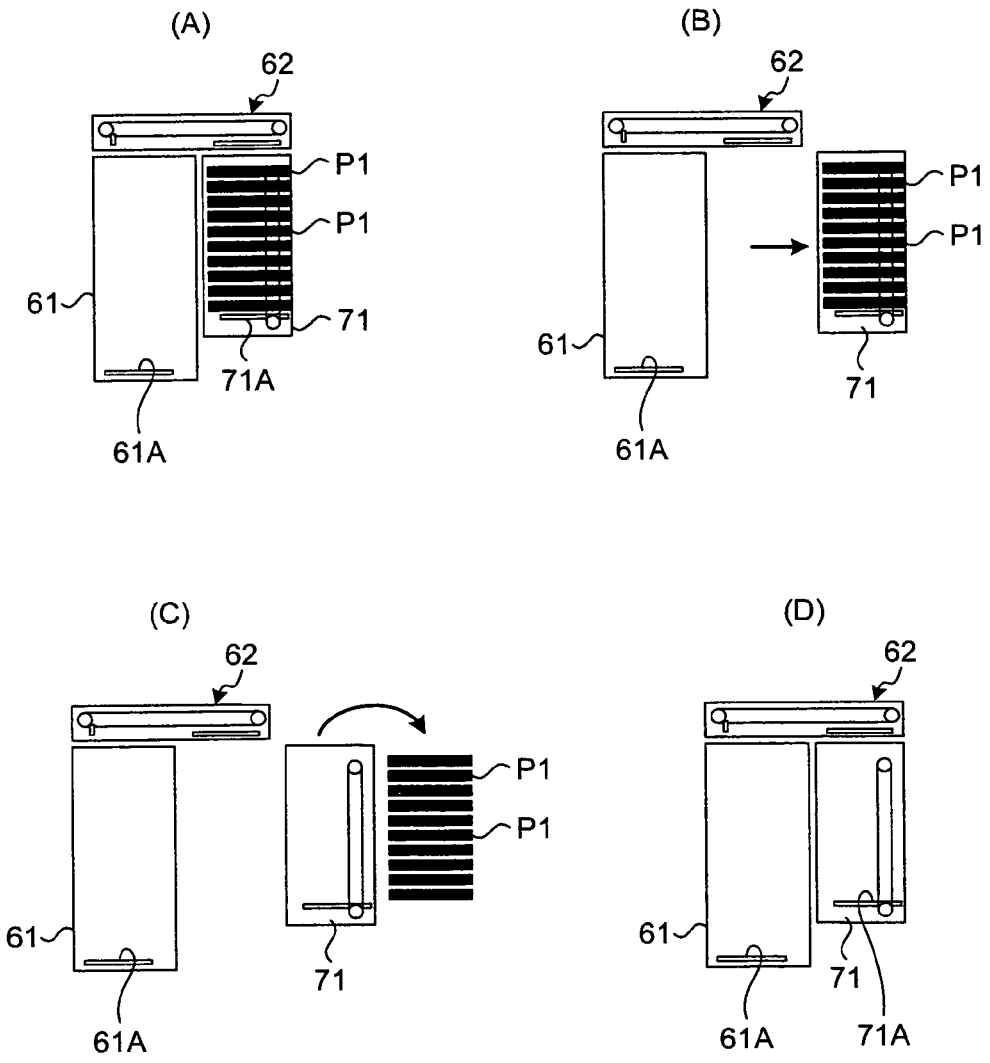
FIG. 10 is an explanatory view illustrating the operation flow of the dispensing transport unit.

The operation, of the dispensing transport unit 28 of the post-bundling transport unit 26, for transporting the banknote bundle P1, which is transported by the grip transport unit 27, toward the bundle dispensing port 23 will be described below. FIGS. 9 and 10 are explanatory views illustrating the operation flow of the dispensing transport unit 28. The banknote bundle lift unit 61 of the dispensing transport unit 28 keeps, at the bottom position, a transport lift 61A for placing the banknote bundle P1 that is gripped and transported by the grip transport unit 27 (see FIG. 9(A)). While gripping the banknote bundle P1 on the transport lift 61A of the banknote bundle lift unit 61, the grip transport unit 27 transports the banknote bundle P1 (see FIG. 9(B)). The banknote bundle lift unit 61 places the banknote bundle P1 on the transport lift 61A in accordance with the elevating operation of the transport lift 61A (see FIG. 9(C)). After placing the banknote bundle P1 on the transport lift 61A and then releasing the grip on the banknote bundle P1 (see FIG. 9(D)), the grip transport unit 27 moves to the operation preparation position (see FIG. 9(E)).

The banknote bundle lift unit 61 then elevates the transport lift 61A on which the banknote bundle P1 is placed, pushes out a push-out transport unit 62A of the push-out mechanism 62, using a link mechanism 61B, in accordance with the elevation of the transport lift 61A (see FIG. 9(F)), and sets the banknote bundle P1, which has been placed on the transport lift 61A, in the push-out transport unit 62A (see FIG. 9(G)).

The push-out transport unit 62A pushes out and transports the banknote bundle P1, which has been set, toward the front panel of the apparatus (see FIG. 9(H)). The dispensing holding mechanism 63 drops the banknote bundle P1 to the banknote bundle stage 71A in the bundle stacking unit 71 in accordance with the open operation of the open/close plate 71B of the bundle stacking unit 71 and stacks the banknote bundle P1 (see FIG. 9(I)). The bundle number counting unit 171 counts the number of banknote bundles in accordance with the open operation of the open/close plate 71B. The banknote bundle lift unit 61 then lowers the transport lift 61A to the bottom position and the push-out transport unit 62A returns to the original waiting state in accordance with the operation of the link mechanism 61B that links with the lowering operation (see FIGS. 9(I) and 9(J)).

The dispensing holding mechanism 63 adjusts the banknote bundle stage 71A in the bundle stacking unit 71 in order to keep the level of the top banknote bundles P1, which are stacked in the bundle stacking unit 71, at a specific position (see FIG. 9(K)). Thereafter, the dispensing holding mechanism 63 successively stacks banknote bundles P1 in the bundle stacking unit 71 in accordance with the operation of the push-out transport unit 62A for transporting banknote bundles P1 (see FIG. 10(A)). Thereafter, when the number of banknote bundles P1 that are stacked in the bundle stacking unit 71 reaches the designated number, the bundle dispensing unit 72 releases the lock of the bundle stacking unit 71, in which the designated number of banknote bundles P1 are stacked, on the dispensing holding mechanism 63. For this description, it is assumed that the designated number is, for example, 10. When the lock of the bundle stacking unit 71 is released, as illustrated in FIG. 12, the bundle dispensing unit 72 pushes the front portion of the bundle stacking unit 71 toward the front panel of the apparatus so as to cause the bundle stacking unit 71 to protrude from the front panel of the apparatus (see FIG. 10(B)).

A user takes out the designated number of banknote bundles from the take-out opening 71D on the side surface of the bundle stacking unit 71, which is caused to protrude from the front panel, of the apparatus (see FIG. 10(C)). The user pushes back the protruded bundle stacking unit 71 into the dispensing holding mechanism 63 (see FIG. 10(D)). As a result, the dispensing holding mechanism 63 locks the bundle stacking unit 71, holds the bundle stacking unit 71 in the dispensing holding mechanism 63, and similarly repeats dispensing of bundles.

Figure 11:
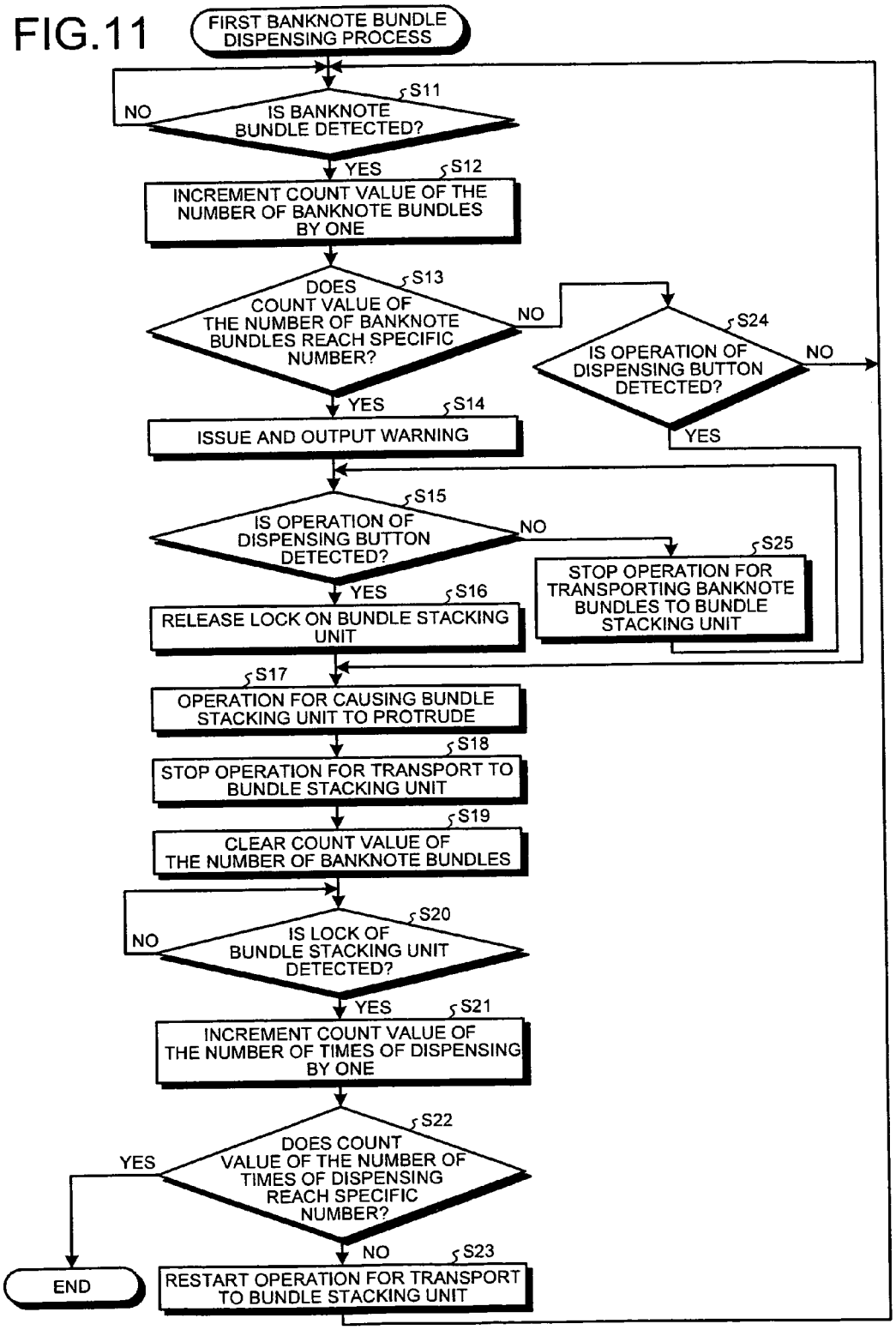
FIG. 11 is a flowchart of a process operation of the control unit that engages in a first banknote bundle dispensing process.

A first banknote bundle dispensing process for dispensing the designated number of banknote bundles P1 will be described below. FIG. 11 is a flowchart of internal process operations of the control unit 170 that engages in the first banknote bundle dispensing process. The first banknote bundle dispensing process illustrated in FIG. 11 is a process in which, when the number of banknote bundles P1 that are stacked in the bundle stacking unit 71 reaches the designated number, the bundle stacking unit 71 in which the designated number of banknote bundles P1 is stacked is caused to protrude from the front panel of the apparatus.

The control unit 170 determines whether a banknote bundle P in the bundle stacking unit 71 is detected via the open/close plate 71B in the bundle stacking unit 71 (step S11). Upon detecting a banknote bundle in the bundle stacking unit 71 (YES at step S11), the bundle number counting unit 171 in the control unit 170 increments the count value of the number of banknote bundles P1 by one (step S12).

The bundle number determining unit 172 in the control unit 170 determines whether the count value of the number of banknote bundles P1 reaches the designated number (step S13). The designated number corresponds to the number that is designated by the designating unit 131. When the count value of the number of banknote bundles P1 reaches the designated number (YES at step S13), the warning control unit 173 in the control unit 170 issues and outputs a warning (step S14). The warning output is, for example, an output of a blinking display of the LED of the dispensing button 132 or an audio output of warning sounds. The issuance and output of the warning let the user recognize that the number of banknote bundles that are stacked in the bundle stacking unit 71 has reached the designated number.

Figure 13:
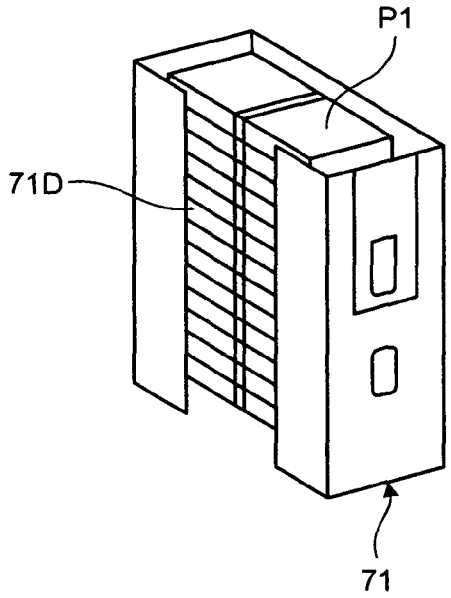
FIG. 13 is an explanatory view of the part of the bundle stacking unit in which banknote bundles are stacked.

After the issuance and output of the warning, the dispensing control unit 174 in the control unit 170 determines whether a button operation of the dispensing button 132 is detected (step S15). Upon detecting a button operation of the dispensing button 132 (YES at step S15), the dispensing control unit 174 releases the lock of the bundle stacking unit 71 on the dispensing holding mechanism 63 (step S16) and pushes the bundle stacking unit 71 toward the front panel of the apparatus via the bundle dispensing unit 72 so that the bundle stacking unit 71 is caused to protrude from the front panel of the apparatus (Step S17). Thus, as illustrated in FIG. 13, the user can take out banknote bundles P1 from the take-out opening 71D on the side surface of the bundle stacking unit 71 that is caused to protrude from the front panel of the apparatus.

When the operation for causing the bundle stacking unit 71 to protrude from the front panel of the apparatus is complete, the transport control unit 175 in the control unit 170 stops the operation for transporting banknote bundles to the bundle stacking unit 71, for example, the operation of the push-out transport unit 62A for transporting banknote bundles (step S18). The bundle number counting unit 171 clears the count value of the number of banknote bundles (step S19).

When the count value of the number of banknote bundles is cleared, the dispensing control unit 174 determines whether it is detected that the bundle stacking unit 71 is locked on the dispensing holding mechanism 63 by pushing back the bundle stacking unit 71 into the dispensing holding mechanism 63 (step S20). When it is detected that the bundle stacking unit 71 is locked on the dispensing holding mechanism 63 (YES at step S20), the dispensing control unit 174 increments the count value of the number of times of dispensing by 1 (step S21) and determines whether the count value of the number of times of dispensing has reached the number of times of dispensing that is designated by the designating unit 131 (step S22). When the count value of the number of times of dispensing reaches the designated number of times of dispensing (YES at step S22), the dispensing control unit 174 completes the process operations illustrated in FIG. 11.

When the count value of the number of times of dispensing does not reach the designated dispensing time number (NO at step S22), the transport control unit 175 restarts the operation for transporting banknote bundles P1 to the bundle stacking unit 71, for example, the operation of the push-out transport unit 62A for transporting banknote bundles (step S23). The control unit 170 then goes to step S11 in order to determine whether a banknote bundle P1 is detected. When a banknote bundle P1 is not detected (NO at step S11), the control unit 170 goes to step S11 in order to determine whether a banknote bundle is detected.

When the count value of the number of banknote bundles P1 does not reach the designated number (No at step S13), the control unit 170 determines whether a button operation of the dispensing button 132 is detected (step S24). When a button operation of the dispensing button 132 is detected (YES at step S24) and even if the designated number is not satisfied, the control unit 170 goes to step S17 in order to cause the bundle stacking unit 71 to protrude from the front panel of the apparatus. When a button operation of the dispensing button 132 is not detected (NO at step S24), the control unit 170 goes to step S11 in order to determines whether a banknote bundle P1 is detected.

When a button operation of the dispensing button 132 is not detected (NO at step S15) after a warning is issued and output, the transport control unit 175 stops the operation for transporting banknote bundles P1 to the bundle stacking unit 71, i.e., the operation of the push-out transport unit 62A for transporting banknote bundles, (step S25) and goes to step S15. Accordingly, additional stacking of new banknote bundles P1 in the bundle stacking unit 71 in excess of the designated number can be prevented.

When it is not detected that the bundle stacking unit 71 is locked on the dispensing holding mechanism 63 (No at step S20), the transport control unit 175 goes to step S20 in order to monitor the lock of the bundle stacking unit 71.

In the first banknote bundle dispensing process illustrated in FIG. 11, when the count value of the number of banknote bundles P1 that are stacked in the bundle stacking unit 71 reaches the designated number, if a button operation of the dispensing button 132 is detected after a warning is issued and output, the bundle stacking unit 71 is pushed out toward the front panel of the apparatus so that the bundle stacking unit 71 is caused to protrude from the front panel of the apparatus. The issuance and output of the warning let the user recognize that the count value of the number of banknote bundles P1 that are stacked in the bundle stacking unit 71 has reached the designated number and let the user acquire the designated number of banknote bundles P1 from the take-put opening 71D of the bundle stacking unit 71.

Furthermore, in the first banknote bundle dispensing process, even when the count value of the number of banknote bundles P1 reaches the designated number, if a button operation of the dispensing button 132 is not detected, the operation for transporting banknote bundles P1 to the bundle stacking unit 71 is stopped. Accordingly, additional stacking of banknote bundles P1 in the bundle stacking unit 71 in excess of the designated number can be prevented.

In the first banknote bundle dispensing process, even when the count value of the number of banknote bundles P1 does not reach the designated number, if a button operation of the dispensing button 132 is detected, banknote bundles P1 that are stacked in the bundle stacking unit 71 can be acquired.

In the first embodiment, a user's desired designated number of banknote bundles and a user's desired number of times the designated number of banknote bundles is dispensed are arbitrarily set using the designating unit 131. In the first embodiment, when the number of banknote bundles P1 that are stacked in the bundle stacking unit 71 reaches the designated number, the bundle stacking unit 71 is pushed out toward the front panel of the apparatus so that the bundle stacking unit 71 is caused to protrude from the front panel of the apparatus. Accordingly, in the first embodiment, operability for collecting the user's desired designated number of banknote bundles P1 is significantly improved.

In the first embodiment, the bundle stacking unit 71 is locked on the dispensing holding mechanism 63 until just before the count value of the number of banknote bundles P1 reaches the designated number, and, when the number of banknote bundles P1 reaches the designated number, the lock of the bundle stacking unit 71 is released to cause the bundle stacking unit 71 to protrude. Accordingly, in the first embodiment, because the user's desired number of banknote bundles is dispensed, operability for collecting banknote bundles can be significantly improved.

In the first embodiment, once the count value of the number of banknote bundles P1 reaches the designated number, a waning is issued and output, and, after the warning is issued and output, the bundle stacking unit 71 is caused to protrude in accordance with a button operation of the dispensing button 132. Thus, in the first embodiment, the issuance of the warning notifies the user that the number of banknote bundles P1 has reached the designated number and it can be prevented that the bundle dispensing unit 72 is automatically caused to protrude without any button operation of the dispensing button 132.

In the first embodiment, even with a bundling function for preparing banknote bundles P1, the operability for collecting the user's desired designated number of banknote bundles P1 while successively preparing banknote bundles P1 can be significantly improved.

In the first embodiment, identical identification numbers are printed on the bundling bands of banknote bundles that are stacked in the bundle stacking unit 71 and are to be collectively dispensed. Accordingly, the user see the identification numbers that are printed on the bundling bands and thus the user can recognize the designated number of banknote bundles P1 that are collectively dispensed. This makes it easy to manage the designated number of banknote bundles.

In the first embodiment, banknote bundles P1 are stacked with the short edge of the banknote bundles P1 being aligned in the back and forth direction of the bundle stacking unit 71, the bundle stacking unit 71 is pushed out toward the front panel of the apparatus, and thus the bundle stacking unit 71 is caused to protrude from the front panel of the apparatus. In the first embodiment, the banknote bundles P1 that are stacked in the bundle stacking unit 71 can be taken out from the take-out opening 71D on the side surface of the bundle stacking unit 71. Accordingly, the bundle stacking unit 71 protrudes and thus the user can take out the designated number of banknote bundles P1 from the take-out opening 71D on the side surface of the bundle stacking unit 71, which leads to preferable operation for taking out the banknote bundles.

In the first embodiment, banknote bundles P1 are successively stacked in the bundle stacking unit 71 via the push-out transport unit 62A of the dispensing transport unit 28. Alternatively, instead of successively stacking banknote bundles P1 in the bundle stacking unit 71, a direct dispensing method of directly dispensing banknote bundles P1 may be employed. This method will be described as a second embodiment below.

Second Embodiment

Figure 14:
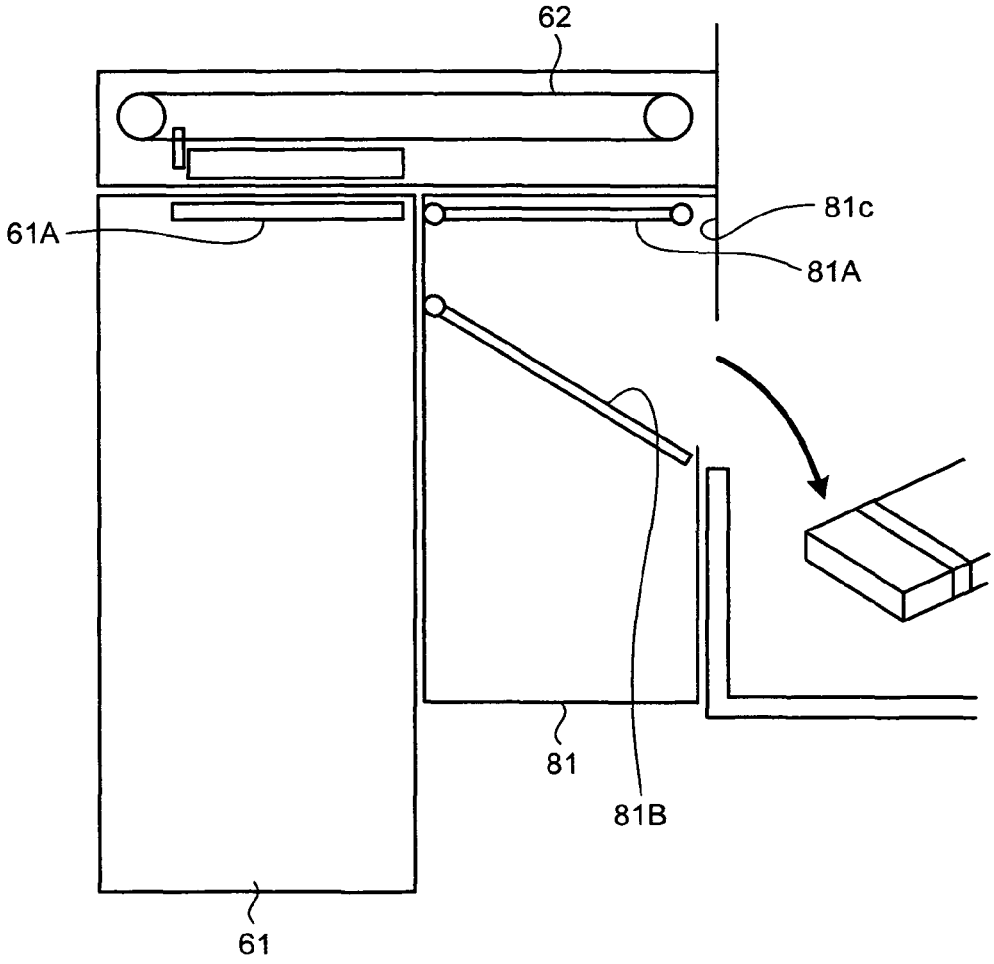
FIG. 14 is an explanatory view illustrating a dispensing holding mechanism (direct dispensing unit) according to a second embodiment that is dispensing a banknote bundle.

FIG. 14 is an explanatory view illustrating the dispensing holding mechanism 63 (direct dispensing unit) according to the second embodiment that is dispensing banknote bundles P1. The same components as those of the banknote processing apparatus 1 according to the first embodiment will be omitted and are denoted by the same reference numerals as those of the banknote processing apparatus 1 and the redundant description on the configurations and operations will be omitted below. In the banknote bundling unit 3 of a banknote processing apparatus 1A according to the second embodiment, the bundle stacking unit 71 in the dispensing holding mechanism 63 is arranged to be attachable to and detachable from a direct dispensing unit 81 and to be switchable. The direct dispensing unit 81 includes an open/close plate 81A, a banknote sliding unit 81B, and an upper opening 81C. When the push-out transport unit 62A pushes out a banknote bundle P1 directly to the direct dispensing unit 81 and the banknote bundle P1 drops from the upper opening 81C in accordance with an open operation of the open/close plate 81A, the banknote sliding unit 81B slides the banknote bundle P1 and dispenses the banknote bundle P1 directly to the outside of the apparatus.

Figure 15:
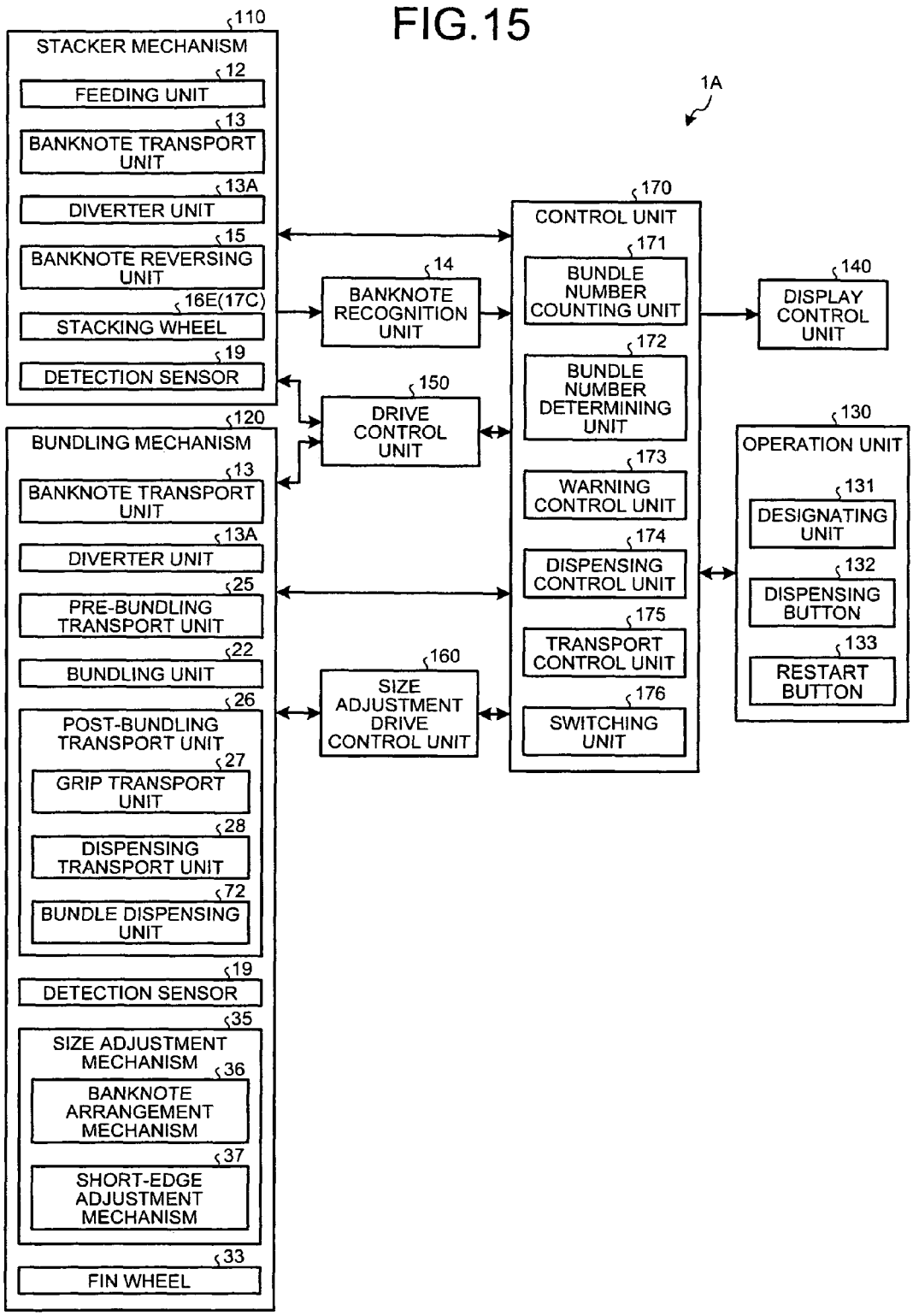
FIG. 15 is a block diagram of the inner configuration of a banknote processing apparatus according to the second embodiment.

FIG. 15 is a block diagram of an inner configuration of the banknote processing apparatus 1A according to the second embodiment. The banknote processing apparatus 1A illustrated in FIG. 15 is different from the banknote processing apparatus 1 according to the first embodiment in that a switching unit 176 for switching between the bundle stacking unit 71 and the direct dispensing unit 81 is provided in a control unit 170A. When the bundle stacking unit 71 is set, until just before the count value of the number of banknote bundles P1 reaches a designated number of banknote bundles, the control unit 170A successively stacks banknote bundles P1 in the bundle stacking unit 71 in accordance with the operation of the push-out transport unit 62A for pushing out a banknote bundle P1. Once the count value of the number of banknote bundles P1 reaches the designated number, the transport control unit 175 inhibits stacking of banknote bundles P1 in the bundle stacking unit 71 by stopping the push-out operation of the push-out transport unit 62A.

In contrast, when the direct dispensing unit 81 is set, until just before the count value of the number of banknote bundles P1 reaches the designated number, the control unit 170A successively dispenses banknote bundles P1 from the direct dispensing unit 81 in accordance with the operation of the push-out transport unit 62A for pushing out a banknote bundle P1. Once the count value of the number of banknote bundles P1 reaches the designated number, the transport control unit 175 inhibits direct dispensing of banknote bundles P1 from the direct dispensing unit 81 by stopping the push-out operation of the push-out transport unit 62A.

Figure 16:
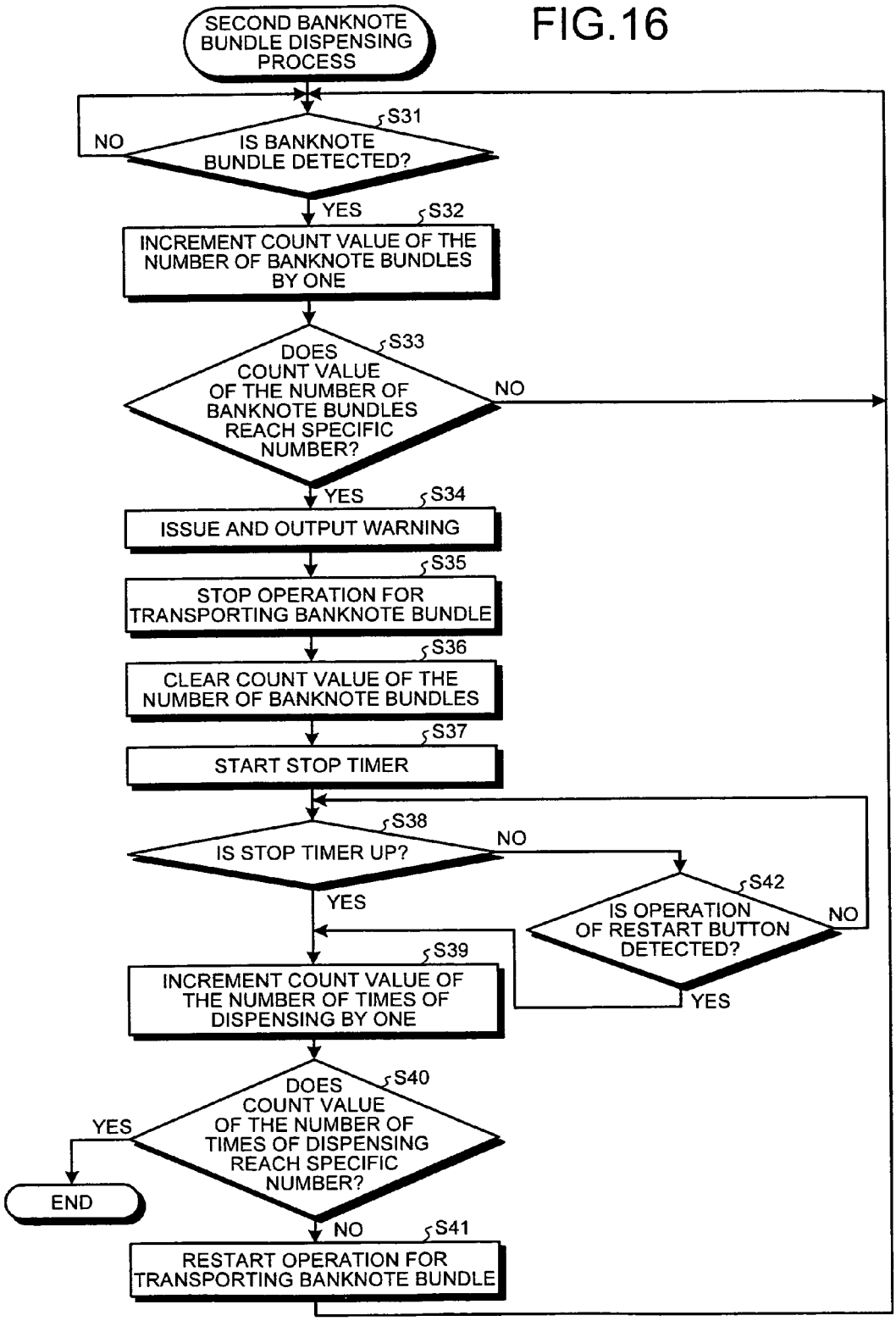
FIG. 16 is a flowchart of a process operation of the control unit that engages in a second banknote bundle dispensing process.

FIG. 16 is a flowchart of internal process operations of the control unit 170A that engages in a second banknote bundle dispensing process. The second banknote bundle dispensing process illustrated in FIG. 16 is a process in which, each time the count value of the number of banknote bundles P1 that are directly dispensed reached the designated number, the user is notified of completion of dispensing of the designated number of banknote bundles P1.

The control unit 170A determines whether a banknote bundle P1 in the direct dispensing unit 81 is detected via the open/close plate 81A (step S31). When a banknote bundle P1 is detected (YES at step S31), the bundle number counting unit 171 in the control unit 170A increments the count value of the number of banknote bundles P1 by 1 (step S32).

The bundle number determining unit 172 in the control unit 170A determines whether the count value of the number of banknote bundles P1 reaches the designated number (step S33). When the count value of the number of banknote bundles P1 reaches the designated number (YES at step S33), the warning control unit 173 in the control unit 170A issues and outputs a warning (step S34). According to, for example, an audio output of warning, the user can recognize that the number of banknote bundles P1 reaches the designated number.

After the issuance and output of the warning, the transport control unit 175 in the control unit 170A stops the operation of the push-out transport unit 62A for pushing out a banknote bundle P1 in order to stop the operation for transporting a banknote bundle P1 to the direct dispensing unit 81 (step S35). The bundle number counting unit 171 clears the count value of the number of banknote bundles (step S36).

Once the count value of the number of banknote bundles is cleared, the transport control unit 175 starts a stop timer (step S37) and determines whether the timer is up (step S38). When the timer is up (YES at step S38), the transport control unit 175 increments the count value of the number of times of dispensing by 1 (step S39) and determines whether the count value of the number of times of dispensing reaches the number of times of dispensing that is designated by the designating unit 131 (step S40). When the count value of the number of times of dispensing reaches the designated number (YES at step S40), the transport control unit 175 finishes the process operations illustrated in FIG. 16. When the count value of the number of times of dispensing does not reach the designated number (NO at step S40), the transport control unit 175 restarts the operation of the push-out transport unit 62A for pushing out a banknote bundle P1 in order to restart the operation for transporting a banknote bundle P1 to the direct dispensing unit 81 (step S41) and the transport control unit 175 goes to step S31 in order to determine whether a banknote bundle P1 is detected. In other words, the stop of direct dispensing during time counting by the stop timer let the user recognize that dispensing of the designated number of banknote bundles P1 is complete.

When dispensing of a banknote bundle P1 to the direct dispensing unit 81 is not detected (NO at step S33), the control unit 170A goes to step S31 in order to continuously monitor a banknote bundle P1 to the direct dispensing unit 81. When the count value of the number of banknote bundles P1 does not reach the designated number (NO at step S33), the bundle number determining unit 172 goes to step S31 in order to monitor a banknote bundle P1 to the direct dispensing unit 81.

When the stop time is not up (NO at step S38), the transport control unit 175 determines whether a button operation of a restart button 133 is detected (step S42). Upon detecting a button operation of the restart button 133 (YES at step S42), the transport control unit 175 goes to step S39 in order to increment the count value of the number of times of dispensing by 1.

When an operation of the restart button 133 is not detected (NO at step S42), the transport control unit 175 goes to step S38 in order to continuously monitor whether the stop timer times up.

In the second banknote bundle dispensing process illustrated in FIG. 16, when the count value of the number of banknote bundles P1 that are dispensed to the direct dispensing unit 81 reaches the designated number, a warning is issued and output and, while the stop timer is counting the time, dispensing of a banknote bundle P1 from the direct dispensing unit 81 is inhibited. As a result, in accordance with issuance and output of the warning and the stop of dispensing a banknote bundle while the stop timer is counting the time, it can be recognized that the count value of the number of banknote bundles P1 has reached the designated number and it can be recognized that dispensing of the designated number of banknote bundles P1 is complete.

Furthermore, in the second banknote bundle dispensing process, when the count value of the number of banknote bundles P1 that are dispensed to the direct dispensing unit 81 reaches the designated number, dispensing of a banknote bundle from the direct dispensing unit 81 is stopped and, after the stop timer is up, the operation for dispensing a banknote bundle P1 is restarted. Thus, even if the operation for dispensing a banknote bundle P1 stops in accordance with the start of the stop timer, the user can restart the operation for dispensing a banknote bundle P1 once the stop timer is up.

In the second embodiment, the direct dispensing unit 81 and the bundle stacking unit 71 are set to be detachable from and attachable to the dispensing holding mechanism 63 and thus the direct dispensing unit 81 and the bundle stacking unit 71 can be switched; therefore, the user can manage direct dispensing of banknote bundles P1 in accordance with the switching to the direct dispensing unit 81.

In the second embodiment, when the setting is switched to the direct dispensing unit 81, dispensing of a banknote bundle from the direct dispensing unit 81 is continued until just before the count value of the number of banknote bundles P1 reaches the designated number, and dispensing of banknote bundles P1 is stopped when the count value of the number of banknote bundles P1 reaches the designated number. Accordingly, in the second embodiment, when the count value of the number of banknote bundles P1 reaches the designated number, the direct dispensing from the direct dispensing unit 81 is stopped; therefore, the user can be notified that direct dispensing of the designated number of banknote bundles P is complete in accordance with the stop of dispensing of banknote bundles P1. Furthermore, operability for collecting the designated number of banknote bundles P1 can be significantly improved.

In the first and second embodiments, identical identification numbers are printed on bundling bands of banknote bundles that are stacked in the bundle stacking unit 71 and are to be dispensed collectively. Instead of identical identification numbers, sequential numbers may be printed. In this case, the user sees the sequential numbers that are printed on the bundling bands and thus the user can recognizes the banknote bundles of the designated number of banknote bundles that are collectively dispensed. This makes it easy to manage the designated number of banknote bundles.

In the first and second embodiments, the single banknote bundling unit 3 is connected to the banknote sorting unit 2 and, when the number of banknote bundles P1 of a specific category of, i.e., of a specific denomination, reaches the designated number, the bundle stacking unit 71 is caused to protrude from the front panel of the apparatus. Alternatively, multiple banknote bundling units 3 may be provided and the banknote bundling units 3 may be allocated with different categories. For example, the first banknote bundling unit 3 is allocated with a category of 20 Euro, the second banknote bundling unit 3 is allocated with a category 10 Euro, and the third banknote bundling unit 3 is allocated with a category of unfit 50-Euro banknote.

In this case, when the number of 20-Euro banknote bundles that are stacked in the bundle stacking unit 71 in the first banknote bundling unit 3 reaches a designated number of banknote bundles, the bundle stacking unit 71 is caused to protrude from the front panel of the apparatus. Similarly, when the number of 10-Euro banknote bundles that are stacked in the bundle stacking unit 71 in the second banknote bundling unit 3 reaches the designated number, the bundle stacking unit 71 is caused to protrude from the front panel of the apparatus. Furthermore, when the number of unfit 50-Euro banknote bundles that are stacked in the bundle stacking unit 71 in the third banknote bundling unit 3 reaches the designated number, the bundle stacking unit 71 is caused to protrude from the front panel of the apparatus. In other words, by additionally providing multiple banknote bundling units 3 and allocating the banknote bundling units 3 with different categories (for example, denomination or fit/unfit banknote), the designated number of banknote bundles of each can be dispensed according to each category.

Instead of additionally providing multiple banknote bundling units 3, by arranging multiple bundle stacking units 71 for respective categories in a single banknote bundling unit 3, every of the designated number of banknote bundles can be dispensed according to each category.

In the first and second embodiments, out of the three bundling stacking units 21, a reserve is set as stacked banknotes for one bundling stacking unit 21, and different denominations of banknotes are set for the rest of two bundling stacking unit 21. Similar effects can be obtained by setting the same denomination of banknotes for the rest of two bundling stacking units 21.

In the first and second embodiments, descriptions are provided taking, as an example, the banknote bundling unit 3 that bundles to-be-bundled-banknotes with a bundling band. Similar effects can be obtained in a case where banknotes, such as gift vouchers or valuable securities, are bundled with a bundling band.

Among the processes described in the first and second embodiments, the processes that are described as those automatically performed may be entirely or partially performed manually and the processes that are described as those manually performed may be entirely or partially performed automatically. In addition, the process procedures, control procedures, specific names, information including various types of data and parameters that are illustrated in the first and second embodiments may be changed arbitrarily unless otherwise noted.

The components of each device illustrated in the drawings are not necessarily required to be physically configured as illustrated in the drawings. In other words, the specific modes of separation or integration of the components are not limited to those illustrated in the drawings. The components may be configured in a way that they are entirely or partially separated or integrated functionally or physically on an arbitrary basis in accordance with various loads or how they are used. For example, the drive control unit 150 and the size adjustment drive control unit 160 may be integrated into a single unit. Among the processes described in the embodiments, the processes that are described as those automatically performed may be entirely or partially performed manually.

In the banknote processing apparatus according to the present invention with the above-described configuration, when the number of banknote bundles reaches the designated number of banknote bundles that is designated by the designating unit, the designated number of banknote bundles that are stacked in the stacking unit is dispensed such that the banknote bundles can be taken out from the outside. Accordingly, in the banknote processing apparatus according to the present invention, effects can be achieved in which operability for collecting the user's desired designated number of banknote bundles can be improved significantly.

In the banknote processing apparatus according to the present invention, in addition to the above-described effects of the present invention, the number of times the designated number of banknote bundles is dispensed or the total number of banknote bundles to be dispensed can be designated and dispensing is repeated until the designated number of times of dispensing is reached or the total number of dispensed banknote bundles reaches the total number of banknote bundles to be dispensed. Accordingly, in the banknote processing apparatus according to the present invention, effects are achieved in which a user can arbitrarily set the number of times of dispensing or the total number of banknote bundles to be dispensed, and, furthermore, operability for collecting banknote bundles until the user's desired designated number of times of dispensing or the user's desired total number of banknote bundles to be dispensed is reached can be significantly improved.

In the banknote processing apparatus according to the present invention, in addition to the above-described effects of the present invention, the banknote bundles cannot be taken out from the outside until just before the number of banknote bundles reaches the designated number, and the banknote bundles can be taken out from the outside when the number of banknote bundles reaches the designated number. Accordingly, in the banknote processing apparatus according to the present invention, because the user's desired designated number of banknote bundles are dispensed, effects are achieved in which the operability for collecting the banknote bundles can be improved significantly.

In the banknote processing apparatus according to the present invention, in addition to the above-described effects of the present invention, the bundle stacking unit in which the banknote bundles are stacked is caused to protrude to the outside such that the banknote bundles can be taken out from the outside. Accordingly, the effects can be achieved in which the user can collect the designated number of banknote bundles from the protruding bundle stacking unit.

In the banknote processing apparatus according to the present invention, in addition to the above-described effects of the present invention, when the number of banknote bundles reaches the designated number, a warning is issued, and, after the warning is issued, in accordance with a predetermined operation, the banknote bundles that are stacked in the bundle stacking unit are dispensed such that the banknote bundles can be taken out from the outside. Accordingly, in the banknote processing apparatus according to the present invention, effects are achieved in which the issuance of the warning notifies the user that the number of banknote bundles reaches the designated number and it can be prevented that the banknote bundles are automatically dispensed suddenly without the predetermined operation.

In the banknote processing apparatus according to the present invention, in addition to the above-described effects of the present invention, effects are achieved in which, even with a bundling function for preparing banknote bundles, operability for collecting the user's desired designated number of banknote bundles while successively preparing banknote bundles can be significantly improved.

In the banknote processing apparatus according to the present invention, in addition to the above-described effects of the present invention, the identical identification information is printed on the bundling bands of the banknote bundles that are dispensed collectively by the bundle dispensing unit. Accordingly, because the user can see the identification information, which is printed on the bundling bands, and recognize the designated number of banknote bundles that are dispensed collectively, effects are achieved in which the designated number of banknote bundles can be easily managed.

In the banknote processing apparatus according to the present invention, in addition to the above-described effects of the present invention, the sequential numbers are printed on the bundling bands of the banknote bundles that are collectively dispensed by the bundle dispensing unit. Accordingly, because the user can see the sequential numbers that are printed on the bundling bands and recognize the designated number of banknote bundles that are collectively dispensed, effects are achieved in which the designated number of banknote bundles can be managed easily.

In the banknote processing apparatus according to the present invention, in addition to the above-described effects of the present invention, because the banknote bundles that are stacked in the bundle stacking unit can be taken out in the longitudinal direction of the banknote bundles, effects are achieved in which the user's operation for taking out the designated number of banknote bundles in the longitudinal direction of the banknote bundles becomes preferable.

In the banknote processing apparatus according to the present invention, in addition to the above-described effects of the present invention, the banknote bundles are stacked with the short edge of the banknote bundles being aligned with the back and forth direction of the bundle stacking unit, the front portion of the bundle stacking unit is pushed toward the front panel, and thus the bundle stacking unit is caused to protrude from the front panel. Accordingly, because the bundle stacking unit protrudes, effects are achieved in which the user's operation for taking out the designated number of banknote bundles from the bundle stacking unit becomes preferable.

In the banknote processing apparatus according to the present invention, in addition to the above-described effects of the present invention, once the bundle stacking unit is caused to protrude from the front panel, the banknote bundles that are stacked in the bundle stacking unit can be taken out from the take-out opening on the side surface of the bundle stacking unit. Accordingly, because the user can take out the designated number of banknote bundles from the take-out opening on the side surface of the bundle stacking unit, effects are achieved in which the take-out operation becomes preferable.

In addition to the above-described effects of the present invention, the banknote processing apparatus according to the present invention further includes the direct dispensing unit that dispenses the banknote bundles, which are transported by the bundle transport unit, to the outside and the bundle stacking unit and the direct dispensing unit can be switched. Accordingly, in the banknote processing apparatus according to the present invention, effects are achieved in which direct dispensing of the banknote bundles can be managed in accordance with the switching.

In the banknote processing apparatus according to the present invention, in addition to the above-described effects of the present invention, after the setting is switched to the direct dispensing unit, dispensing of the banknote bundles from the direct dispensing unit is continued until just before the number of banknote bundles reaches the designated number, dispensing of the banknote bundles from the direct dispensing unit is stopped once the number of banknote bundles reaches the designated number. Accordingly, in the banknote processing apparatus according to the present invention, because dispensing from the direct dispensing unit is stopped when the number of banknote bundles reaches the designated number, effects are achieved in which the user can recognize that dispensing of the designated number of banknote bundles is complete.

In the banknote bundle dispensing method according to the present invention with the above-described configuration, when the number of banknote bundles reaches the designated number of banknote bundles, the designated number of banknote bundles that are stacked in the bundle stacking unit are dispensed such that the banknote bundles can be taken out from the outside. Accordingly, in the banknote bundle dispensing method according to the present invention, effects are achieved in which operability for collecting the user's desired designated number of banknote bundles can be significantly improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A banknote processing apparatus comprising:

a bundle transport unit for transporting banknote bundles, wherein each banknote bundle is a predetermined number of banknotes that are bundled with a bundling band;

a bundle stacking unit for stacking the banknote bundles that are transported by the bundle transport unit;

a bundle dispensing unit for dispensing the banknote bundles that are stacked in the bundle stacking unit;

a designating unit for designating a specific number of banknote bundles;

a direct dispensing unit for dispensing the banknote bundles that are transported by the bundle transport unit, to the outside; and a control unit for controlling, when the number of banknote bundles stacked in the bundle stacking unit reaches the specific number that is designated by the designating unit, the bundle dispensing unit to dispense the specific number of banknote bundles that are stacked in the bundle stacking unit, such that the banknote bundles can be taken out from the outside; and wherein the bundle stacking unit and the direct dispensing unit are switchable, and when the banknote bundles are dispensed from the bundle stacking unit, the control unit is configured to control the bundle dispensing unit such that the bundle stacking unit juts from a front panel of the banknote processing apparatus and the banknote bundles are placed at a position where the banknote bundles protrude from the front panel.

2. The banknote processing apparatus according to claim 1, wherein the designating unit is configured to designate the number of times the specific number of banknote bundles is dispensed or the total number of banknote bundles to be dispensed, and when the banknote bundles are dispensed from the bundle stacking unit, the control unit is configured to control the bundle dispensing unit to repeat dispensing until the designated number of times of dispensing is reached or until the total number of dispensed banknote bundles reaches the designated total number of banknote bundles to be dispensed.

3. The banknote processing apparatus according to claim 1, wherein when the banknote bundles are dispensed from the bundle stacking unit, the control unit is configured to control the bundle dispensing unit such that the banknote bundles cannot be taken out from the outside until just before the number of banknote bundles reaches the specific number that is designated by the designating unit, and the control unit is configured to control the bundle dispensing unit such that the banknote bundles can be taken out from the outside when the number of banknote bundles reaches the specific number.

4. The banknote processing apparatus according to claim 1, wherein the bundle stacking unit includes an opening, such that a part of the banknote bundles can be seen, and wherein when the banknote bundles are dispensed from the bundle stacking unit, the control unit is configured to control the bundle dispensing unit to push out the bundle stacking unit in which the banknote bundles are stacked toward the front panel of the banknote processing apparatus, such that the bundle stacking unit protrudes from the front panel and the banknote bundles are taken out by using the opening.

5. The banknote processing apparatus according to claim 4, wherein the bundle stacking unit is arranged in the bundle dispensing unit so as to stack the banknote bundles with the short edge of the banknote bundles being aligned in the back and forth direction of the banknote processing apparatus, and the bundle dispensing unit pushes the bundle stacking unit forward so that the bundle stacking unit protrudes from the front panel of the banknote processing apparatus.

6. The banknote processing apparatus according to claim 5, wherein, when the bundle dispensing unit causes the bundle stacking unit to protrude from the front panel, the banknote bundles that are stacked in the bundle stacking unit can be taken out from the opening on a side surface of the bundle stacking unit.

7. The banknote processing apparatus according to claim 1, wherein when the banknote bundles are dispensed from the bundle stacking unit and the number of banknote bundles reaches the specific number that is designated by the designating unit, the control unit issues a warning and, after the warning is issued, controls the bundle dispensing unit, in accordance with a predetermined operation, to dispense the banknote bundles that are stacked in the bundle stacking unit such that the banknote bundles can be taken out from the outside.

8. The banknote processing apparatus according to claim 1, further comprising:

a feeding unit for feeding inserted banknotes;

a banknote stacking unit for successively stacking the banknotes that are fed by the feeding unit; and a bundling unit for preparing the banknote bundle by bundling a predetermined number of banknotes that are stacked in the banknote stacking unit, with a bundling band, wherein the bundle transport unit is configured to transport the banknote bundle that is bundled by the bundling unit.

9. The banknote processing apparatus according to claim 1, further comprising a printing unit for printing on the bundling band of the banknote bundle, wherein the control unit is configured to control the printing unit to print identical identification information on the bundling bands of the banknote bundles that are dispensed collectively by the bundle dispensing unit.

10. The banknote processing apparatus according to claim 1, further comprising a printing unit for printing letters on the bundling band of the banknote bundle, wherein the control unit is configured to control the printing unit to print sequential numbers on the bundling bands of the banknote bundles that are collectively dispensed by the bundle dispensing unit.

11. The banknote processing apparatus according to claim 1, wherein the bundle dispensing unit is configured to dispense the banknote bundles such that the banknote bundles can be taken out from the long-edge side of the banknote bundles.

12. A banknote processing apparatus comprising:

a bundle transport unit for transporting banknote bundles;

a bundle stacking unit for stacking the banknote bundles that are transported by the bundle transport unit, the banknote bundles stacked in the bundle stacking unit can be removed from an outside of the banknote processing apparatus; and a direct dispensing unit for dispensing the banknote bundles that are transported by the bundle transport unit, to the outside, wherein the bundle stacking unit and the direct dispensing unit are switchable.

13. The banknote processing apparatus according to claim 12, further comprising a designating unit for designating a specific number of banknote bundles; and a control unit that continues, after a setting is switched to the direct dispensing unit, dispensing of the banknote bundles from the direct dispensing unit until just before the number of banknote bundles reaches the specific number that is designated by the designating unit and the control unit stops dispensing of the banknote bundles from the direct dispensing unit when the number of banknote bundles has reached the specific number that is designated by the designating unit.

14. The banknote processing apparatus according to claim 13, wherein, when the banknote bundles are dispensed from the bundle stacking unit, the control unit controls the bundle dispensing unit such that the banknote bundles stacked in the bundle stacking unit cannot be taken out from the outside until just before the number of banknote bundles stacked in the bundle stacking unit reaches the specific number designated by the designating unit, and the control unit controls the bundle dispensing unit such that the banknote bundles stacked in the bundle stacking unit can be taken out from the outside when the number of banknote bundles stacked in the bundle stacking unit reaches the specific number.

15. The banknote processing apparatus according to claim 12, further comprising:

a bundle dispensing unit for dispensing the banknote bundles that are stacked in the bundle stacking unit;

a designating unit for designating a specific number of banknote bundles; and a control unit for controlling, when the number of banknote bundles reaches the specific number that is designated by the designating unit, the bundle dispensing unit to dispense the specific number of banknote bundles that are stacked in the bundle stacking unit, such that the banknote bundles can be taken out from the outside.

16. A banknote bundle dispensing method for a banknote processing apparatus that includes a bundle transport unit for transporting banknote bundles, a bundle stacking unit for stacking the banknote bundles that are transported by the bundle transport unit, a bundle dispensing unit for dispensing the banknote bundles that are stacked in the bundle stacking unit, and a direct dispensing unit for dispensing the banknote bundles that are transported by the bundle transport unit, to an outside of the banknote processing apparatus, the banknote bundle dispensing method comprising:

designating a specific number of banknote bundles, wherein each banknote bundle includes a predetermined number of banknotes that are bundled with a bundling band; and dispensing the banknote bundle from the direct dispensing unit or the banknote bundle from the bundle dispensing unit, wherein the bundle stacking unit and the direct dispensing unit are switchable.

17. The banknote bundle dispensing method according to claim 16, further comprising:

controlling, when the number of banknote bundles stacked in the bundle stacking unit reaches the specific number, the bundle dispensing unit such that the banknote bundles in the bundle stacking unit can be taken out from an outside of the banknote bundle processing apparatus.

18. The banknote bundle dispensing method according to claim 17, wherein the bundle dispensing unit is controlled such that the bundle stacking unit juts from a front panel of the banknote processing apparatus and the banknote bundles are placed at a position where the banknote bundles protrude from the front panel.

* * * * *